US005766833A

United States Patent [19]

Suematsu et al.

[11] Patent Number: 5,766,833

[45] Date of Patent: Jun. 16, 1998

[54] PROCESS OF FORMING SUPER HIGH-CONTRAST NEGATIVE IMAGES AND SILVER HALIDE PHOTOGRAPHIC MATERIAL AND DEVELOPER BEING USED THEREFOR

[75] Inventors: Kiyoshi Suematsu; Hiroaki Muratake; Haruhiko Kaji; Naoki Obi, all of Tokyo; Yasuhiko Kojima; Yasuo Shigemitsu, both of Saitama, all of Japan

[73] Assignee: Dainippon Ink and Chemicals Inc., Tokyo, Japan

[21] Appl. No.: 889,576

[22] Filed: Jul. 8, 1997

Related U.S. Application Data

[62] Division of Ser. No. 713,188, Sep. 12, 1996, Pat. No. 5,683,854, which is a continuation of Ser. No. 507,198, Jul. 26, 1995, abandoned.

[30] Foreign Application Priority Data

Jul. 29, 1994 [JP] Japan ..... 6-178346
Feb. 21, 1995 [JP] Japan ..... 7-032241

[51] Int. Cl.[6] ..... G03C 5/305

[52] U.S. Cl. ..... 430/489; 430/477; 430/480; 430/481; 430/482; 430/483; 430/486; 548/126; 548/134

[58] Field of Search ..... 430/477, 480, 430/481, 482, 483, 486, 489; 548/126, 134

[56] References Cited

U.S. PATENT DOCUMENTS

| | | | |
|---|---|---|---|
| 3,623,873 | 11/1971 | Brown et al. | 430/406 |
| 5,196,298 | 3/1993 | Meeus et al. | 430/483 |
| 5,217,842 | 6/1993 | Kojima et al. | 430/487 |
| 5,278,035 | 1/1994 | Knapp | 430/441 |
| 5,284,733 | 2/1994 | Kojima et al. | 430/440 |
| 5,372,911 | 12/1994 | Obi et al. | 430/264 |
| 5,683,854 | 11/1997 | Suematsu et al. | 430/480 |

FOREIGN PATENT DOCUMENTS

| | | |
|---|---|---|
| 0 480 304 A | 4/1992 | European Pat. Off. . |
| 2031314 | 1/1971 | Germany . |
| 2 321 401 | 11/1973 | Germany . |
| 2 165 955 | 4/1986 | United Kingdom . |

*Primary Examiner*—Hoa Van Le

*Attorney, Agent, or Firm*—Armstrong, Westerman, Hattori, McLeland & Naughton

[57] ABSTRACT

An image-forming process developing a previously image-exposed silver halide photographic material with an alkaline developer containing a reductone compound as a main developing agent in the presence of a 1,2,5-thiadiazole compound and/or a 2,1,3-benzothiadiazole compound, and the silver halide photographic material and the photographic developer being used for the process are disclosed. In this case, the 1,2,5-thuiadiazole compound and/or the 2,1,3-benzothiadiazole may be contained in the silver halide photographic material and/or the alkaline developer. Super high-contrast images for photomechanical process having a gamma of higher than 15 and having no pepper and less fog can be obtained.

3 Claims, No Drawings

PROCESS OF FORMING SUPER HIGH-CONTRAST NEGATIVE IMAGES AND SILVER HALIDE PHOTOGRAPHIC MATERIAL AND DEVELOPER BEING USED THEREFOR

This is a divisional of application Ser. No. 08/713,188 filed Sep. 12, 1996, U.S. Pat. No. 5,683,854, which is a continuation of Ser. No. 08/507,198 filed Jul. 26, 1995, abandoned.

The present invention relates to a novel and useful process of forming super high-contrast images. More particularly, the invention relates to a process of forming super high-contrast negative images useful for a printing photomechanical process of graphic arts and a silver halide photographic material and a photographic developer being used for the process.

BACKGROUND OF THE INVENTION

Since in a printing photomechanical process of graphic arts, the formation of sharp dot images or line images is required, an image-forming system showing high-contrast (in particular, a gamma of at least 10) photographic characteristics is necessary.

Hitherto, for the foregoing purpose, a specific developer called a lith developer has been used.

The lith developer contains hydroquinone only as the developing agent and the concentration of a free sulfite ion, which is a preservative is greatly lowered (usually not higher than 0.1 mol/liter) for not obstructing the infectious developing property. Thus, the lith developer has the fault that the developer is easily air-oxidized and the liquid activity becomes very unstable.

As other image-forming systems for obtaining high-contrast photographic characteristics, there are processes of using the hydrazine compounds described in U.S. Pat. Nos. 4,168,977, 4,224,401, 4,241,164, 4,243,734, 4,269,929, 4,272,614, 4,311,781, 4,323,643, 4,385,108, 4,650,746, 4,686,167, 4,927,734, 4,988,604, 4,994,365, and 5,041,355; European Patents 253,665, 322,553, 333,435, 345,025, and 356,898; JP-A-56-106244, JP-A-61-267759, JP-A-61-230145, JP-A-62-270953, JP-A-62-178246, JP-A-62-180361, JP-A-62-275247, JP-A-63-223744, JP-A-63-234244, JP-A-63-234245, JP-A-63-234246, JP-A-63-253357, JP-A-63-265239, JP-A-2-77057, JP-A-2-220042, JP-A-2-221953, JP-A-4-438, JP-A-4-5652, JP-A-4-5653, JP-A-4-6548, JP-A-4-6551, JP-A-4-9037, JP-A-4-15642, JP-A-4-16938, JP-A-19645, JP-A-4-19646, JP-A-4-19647, JP-A-4-19732, JP-A-4-21841, JP-A-4-29130, JP-A-4-34430, JP-A-4-34545, JP-A-4-51142, JP-A-4-51143, JP-A-4-56842, JP-A-4-56843, JP-A-4-56846, JP-A-4-56949, JP-A-4-60545, JP-A-4-62544, JP-A-4-67140, JP-A-4-67141, JP-A-4-70647, JP-A-4-76530, JP-A-4-76531, JP-A-4-76532, JP-A-4-76533, JP-A-4-76534, JP-A-4-77732, JP-A-4-80741, JP-A-80748, JP-A-4-81841, JP-A-4-84134, JP-A-4-96053, JP-A-4-98239, JP-A-4-98240, JP-A-4-106542, JP-A-4-114145, JP-A-114150, JP-A-4-119349, JP-A-122926, JP-A-4-133051, JP-A-4-136838, JP-A-4-136839, JP-A-4-136840, JP-A-4-136841, JP-A-4-136843, JP-A-4-161948, JP-A-4-163446, JP-A-4-163543, JP-A-4-166835, JP-A-174424, JP-A-4-178644, JP-A-186343, JP-A-190227, JP-A-4-194923, JP-A-4-194928, JP-A-4-212144, JP-A-4-212950, JP-A-4-212952, JP-A-4-216544, JP-A-4-218039, JP-A-4-225346, JP-A-4-225347, JP-A-4-225348, JP-A-4-225349, JP-A-4-229859, JP-A-4-245243, JP-A-4-250444, JP-A-4-253051, JP-A-4-258951, JP-A-4-264440, JP-A-4-264545, JP-A-4-265970, JP-A-4-265971, JP-A-4-267248, JP-A-4-273241, JP-A-4-275541, JP-A-4-278939, JP-A-4-280245, JP-A-4-283743, JP-A-4-285951, JP-A-4-291337, JP-A-4-298736, JP-A-4-311946, JP-A-4-316038, JP-A-4-316042, JP-A-4-317054, JP-A-4-321023, JP-A-4-330432, JP-A-4-331951, JP-A-4-338745, JP-A-4-365032, JP-A-5-10675, JP-A-5-11384, JP-A-5-34853, JP-A-5-34854, JP-A-5-45761, JP-A-5-45762, JP-A-5-45763, JP-A-5-45764, JP-A-5-45765, JP-A-5-45767, JP-A-5-61139, JP-A-5-61140, JP-A-5-61141, JP-A-5-61142, JP-A-5-61143, JP-A-5-61144, JP-A-5-61145, JP-A-5-61146, JP-A-61159, JP-A-5-66526, JP-A-5-88288, JP-A-5-88290, JP-A-5-93977, JP-A-5-93990, JP-A-5-100371, JP-A-5-107667, JP-A-5-119422, JP-A-119426, JP-A-5-127285, JP-A-5-127286, JP-A-5-127287, JP-A-5-134337, JP-A-5-134338, JP-A-5-134339, JP-A-5-134357, JP-A-5-142688, JP-A-5-142689, JP-A-5-150392, JP-A-5-158179, JP-A-5-165134, JP-A-5-173281, JP-A-5-197057, JP-A-5-197091, JP-A-5-204075, JP-A-5-204076, JP-A-5-216151, JP-A-5-216181, JP-A-5-216182, JP-A-5-224330, JP-A-5-232616, JP-A-5-241264, JP-A-5-249624, JP-A-5-257223, JP-A-5-257239, JP-A-5-257240, JP-A-5-265148, JP-A-5-265149, JP-A-5-273681, JP-A-5-273709, etc. The term "JP-A" as used herein means an "unexamined published Japanese patent application.

According to the process, by processing a surface latent image-type silver halide photographic material containing a specific hydrazine derivative (generally an acylphenylhydrazine derivative) as a nucleating agent with an alkaline developer, the photographic characteristics having a high contrast of higher than 10 in gamma and a high sensitivity are obtained. Since it is permitted to add a sulfite of a high concentration to the developer being used for the new image-forming system, the stability of the liquid activity to air oxidation is improved as compared with the lith developer. However, in the system, there is a problem that a large amount of hydroquinone, which is toxic and becomes an environmental pollution material has to be used for maintaining the photographic activity of the developer at constant.

As described above, in the developers conventionally used, it is necessary to maintain the amount of hydroquinone in the developer above a definite level by using a large amount of hydroquinone, which is toxic and an environmental pollution material, or supplying the amount of hydroquinone consumed by an air oxidation for keeping the developing activity of the developer, and thus the development of a high-contrast image-forming system with a developer showing a less consumed amount of hydroquinone or using no hydroquinone as the developing agent has been desired.

As the developer which can be used for the printing photomechanical process of graphic arts and does not use hydroquinone as the main developing agent, there are the developer containing four components of a reductone compound, an aminophenol, a quaternary ammonium salt compound, and a specific indazole compound as described in JP-A-4-32838 and JP-A-4-128742, the developer using an ascorbic acid main developing agent at pH of at least 12.0 as described in JP-A-5-88306 and JP-A-5-210220, the developing process developing a silver halide photographic material containing a specific quaternary salt compound using a developer containing an L-ascorbic acid as the developing agent as described in JP-A-5-273710 and JP-A-5-53231, the developer containing an ascorbic acid developing agent for developing a silver halide photographic material containing a hydrazine compound as described in U.S. Pat. Nos. 5,264,323 and 5,236,816, the developer containing a reductone compound for developing a silver halide photographic material containing a quaternary ammonium salt polymer as described in U.S. Pat. No. 5,284,733 and JP-A-5-142687, the developer containing an aminophenol derivative developing agent and a reductone compound for developing a silver halide photographic material containing an organic compound having a negative reduction potential as described in JP-A-6-436026 and U.S. Pat. No. 5,372,911, etc.

However, since these developers each has high pH, there are problems that the photographic performance is unstable and in the case of processing by an automatic processor, the formation of fog becomes high, and there are yet problems for practically using these developers.

On the other hand, examples of using the photographic developer having added thereto a thiadiazole compound for the purpose of preventing the formation of a silver sludge in the developer are described in JP-A-57-26848, JP-A-58-169147, JP-A-62-56959, JP-A-4-333046, etc.

Also, examples of adding a thiadiazole compound to a processing solution for silver halide color photographic materials for the purpose of stabilizing the development processing latitude and the color balance are described in JP-A-62-178262, JP-B-5-38942, and JP-B-5-74809. The term "JP-B" as used herein means an "examined Japanese patent publication".

Furthermore, the thiadiazole compounds which are known to be used as developing agents described in JP-A-53-61334, etc., are, in any cases, 1,3,4-thiadiazole compounds and at present examples of using 1,2,5-thiadiazole compounds for the developer have not yet been found at present.

Also, an example of adding a 1,2,5-thiadiazole compound and/or a 2,1,3-benzothiadiazole compound to a silver halide photographic material is described in German Patent Application (OLS) No. 2,031,314, wherein the 2,1,3-benzothiadiazole compound having a nitro group on the benzene ring is used as an antifoggant but in this case, the ganuna is at most about 3. Thus, it has never been known that a 1,2,5-thiadiazole compound and/or a 2,1,3-benzothiadizole compound causes a high contrast of a gamma of higher than 10.

As described above, the photographic effect that a 1,2,5-thiadiazole compound and/or a 2,1,3-benzothiadiazole compound causes a remarkable development acceleration and giving a very high contrast has not hitherto been known.

SUMMARY OF THE INVENTION

The first object of the present invention is to provide a negative image-forming process capable of giving good images having a contrast of higher than 10 in gamma using a stable developer without using hydroquinone, which is toxic and causes an environmental pollution, as the main developing agent.

The second object of the present invention is to provide a negative-working silver halide photographic material which is used for the foregoing image-forming process.

Furthermore, the third object of the present invention is to provide an alkaline developer containing a stable reductone compound as the main developing agent, which is used for the foregoing image-forming process.

It has now been discovered that the foregoing objects can be attained by the present invention described hereinbelow.

That is, an aspect of the present invention is a process of forming super high-contrast negative images, which comprises after image-exposing a negative-working silver halide photographic material having on a support at least one negative-working silver halide emulsion layer and, if necessary, other hydrophilic colloid layer, development processing the silver halide photographic material thus exposed with an alkaline developer containing a reductone compound in the existence of at least one kind of a 1,2,5-thiadiazole compound and/or a 2,1,3-benzothiadiazole compound.

Other aspect of the present invention is a negative-working silver halide photographic material comprising a support having formed thereon a negative-working silver halide emulsion layer and, if necessary, other hydrophilic colloid layer, wherein the silver halide emulsion layer and/or the hydrophilic colloid layer contains at least one kind of a 1,2,5-thiadiazole compound and/or a 2,1,3-benzothiadiazole compound.

Another aspect of the present invention is an alkaline developer for developing a negative-working silver halide photographic material, said developer contains at least one kind of a 1,2,5-thiadiazole compound and/or a 2,1,3-benzothiadiazole compound together with a reductone compound.

DETAILED DESCRIPTION OF THE INVENTION

The invention is described in more detail hereinbelow.

The function and mechanism of the 1,2,5-thiadiazole compound and the 2,1,3-benzothiadiazole compound being used in this invention have not yet been sufficiently clarified but it is presumed that when the compound exists at processing a silver halide photographic material with an alkaline developer containing a reductone compound as the main developing agent, the compound imagewise performs a nucleating reaction to act as a high-contrast giving agent for increasing the sensitivity and the contrast of the silver halide photographic material. The function of giving the greatly high sensitivity and the super high-contrast by the 1,2,5-thiadiazole compound and/or the 2,1,3-benzothiadiazole compound in the image-forming process using an alkaline developer containing a reductone compound as the main developing agent has not yet been known and is an entirely unexpected effect.

As the embodiment of processing a silver halide photographic material with an alkaline developer in the existence of the 1,2,5-thiadiazole compound and/or the 2,1,3-benzothiadiazole compound in the present invention, there are, for example, an embodiment of coating a negative-working silver halide photographic material with a solution previously containing the 1,2,5-thiadiazole compound and/or the 2,1,3-benzothiadiazole compound followed by drying, an embodiment of after imagewise exposing a negative-working silver halide photographic material, coating the photographic material with the foregoing solution followed by drying, and an embodiment of using the pre-bath of the foregoing solution before the processing and these embodiments are included in the embodiments of the present invention. However, the following three kinds of embodiments are main embodiments of the present invention. That is, there are usually an embodiment (1), wherein after imagewise exposing a negative-working silver halide photographic material, the photographic material is processed with an alkaline developer containing the 1,2,5-thiadiazole compound and/or the 2,1,3-benzothiadiazole compound together with a reductone compound, an embodiment (2), wherein after imagewise exposing a negative-working silver halide photographic material containing the 1,2,5-thiadiazole compound and/or the 2,1,3-benzothiadiazole compound, the photographic material is processed with an alkaline developer containing a reductone compound, and an embodiment (3), wherein after imagewise processing a negative-working silver halide photographic material containing the 1,2,5-thiadiazole compound and the 2,1,3-benzothiadiazole compound, the photographic material is processed with an alkaline developer containing the 1,2,5-thiadiazole compound and/or the 2,1,3-benzothiadiazole compound together with a reductone compound.

Since the embodiment (3) described above is considered to be an example of the embodiment (1), wherein specific compound(s) are incorporated in the negative-working silver halide photographic material, the important embodiments (1) and (2) of the present invention are explained below in detail.

That is, in these embodiments, the image formation is carried out in the presence of at least one kind of the 1,2,5-thiadiazole compound and/or the 2,1,3-benzothiadiazole compound shown by following general formula (I), (II), (III), or (IV);

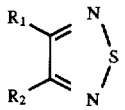

(I)

wherein, $R_1$ and $R_2$, which may be the same or different, each represents a hydrogen atom, a halogen atom, a hydroxy group, a carboxylic acid group or a salt thereof, a sulfonic acid group or a salt thereof, a formyl group, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted carbonyl group, a substituted or unsubstituted carbamoyl group, a substituted or unsubstituted mercapto group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; and said $R_1$ and $R_2$ may form together a ring such as a 5-membered, 6-membered, 7-membered ring, etc., and an aromatic ring, and said ring or aromatic ring may contain therein a hetero atom such as a nitrogen atom, a sulfur atom, an oxygen atom, etc;

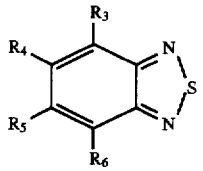

(II)

wherein $R_3$, $R_4$, $R_5$, and $R_6$, which may be the same or different, each represents a hydrogen atom, a halogen atom, a hydroxy group, a carboxylic acid group or a salt thereof, a sulfonic acid group or a salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted carbonyl group, a substituted or unsubstituted carbamoyl group, a cyano group, a substituted or unsubstituted mercapto group, a substituted or unsubstituted thiocarbamoyl group, a substituted or unsubstituted amino group, a substituted or unsubstituted sulfonyl group, a substituted or unsubstituted hydrazino group, a substituted or unsubstituted alicyclic group, a substituted or unsubstituted aromatic group, or a substituted or unsubstituted heterocyclic group, and said $R_3$, $R_4$, $R_5$, and $R_6$ may form together a 5-membered, 6-membered, or 7-membered ring or an aromatic ring, and in this case, these rings and the aromatic ring may contain a hetero atom such as a nitrogen atom, a sulfur atom, or an oxygen atom;

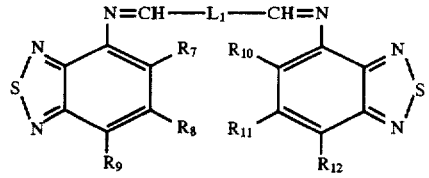

(III)

wherein, $R_7$, $R_8$, $R_9$, $R_{10}$, $R_{11}$, and $R_{12}$, which may be the same or different, each represents a hydrogen atom, a halogen atom, a hydroxy group, a carboxylic acid group or a salt thereof, a sulfonic acid group or a salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted carbonyl group, a substituted or unsubstituted carbamoyl group, a cyano group, a substituted or unsubstituted mercapto group, a substituted or unsubstituted thiocarbamoyl group, a substituted or unsubstituted amino group, a substituted or unsubstituted sulfonyl group, a substituted or unsubstituted hydrazine group, a substituted or unsubstituted alicyclic group, a substituted or unsubstituted aromatic group, or a substituted or unsubstituted heterocyclic group, and said $R_7$, $R_8$, and $R_9$, and/or $R_{10}$, $R_{11}$, and $R_{12}$ may form together a 5-membered, 6-membered, or 7-membered ring or an aromatic ring, and in this case, these rings and the aromatic ring may contain a hetero atom such as a nitrogen atom, a sulfur atom, or an oxygen atom, and $L_1$ represents a divalent linkage group which may be substituted by a substituent;

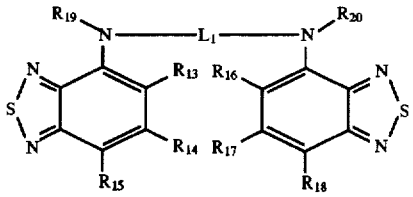

(IV)

wherein $R_{13}$, $R_{14}$, $R_{15}$, $R_{16}$, $R_{17}$, and $R_{18}$ have the same meanings as $R_7$, $R_8$, $R_9$, $R_{10}$, $R_{11}$, and $R_{12}$ in general formula (III); $R_{19}$ and $R_{20}$, which may be the same or different, each represents a hydrogen atom, a substituted or unsubstituted alkyl group, a substituted or unsubstituted alkenyl group, a substituted or unsubstituted alkynyl group, a substituted or unsubstituted aryl group, a substituted or unsubstituted polyalkyleneoxy group, a substituted or unsubstituted acyl group, or a substituted or unsubstituted sulfonyl group; and $L_2$ represents a divalent linkage group which may be substituted with a substituent.

Then, the 1,2,5-thiadiazole compounds and the 2,1,3-benzothiadiazole compounds being used in the present invention are explained below in more detail.

In the compound represented by formula (I) being used in the present invention, $R_1$ and $R_2$ each independently represents a hydrogen atom, a halogen atom (e.g., fluorine, chlorine, bromine, and iodine), a hydroxy group, a carboxy group or a salt thereof, a sulfoxy group or a salt thereof, a substituted or unsubstituted alkyl group (preferably an alkyl group having from 1 to 10 carbon atoms, e.g., methyl, ethyl, propyl, isopropyl, tert-butyl, hexyl, octyl, and decyl), a substituted or unsubstituted alkenyl group (preferably an alkenyl group having from 2 to 10 carbon atoms, e.g., vinyl, allyl, butenyl, octenyl, and 1-butyl-4-hexenyl), a substituted or unsubstituted alkynyl group (preferably an alkynyl group having from 2 to 10 carbon atoms, e.g., propargyl, hexynyl, and octynyl), a substituted or unsubstituted alkoxy group (preferably an alkoxy group having from 1 to 10 carbon atoms, e.g., methoxy, ethoxy, isopropoxy, butoxy, decyloxy, allyloxy, and phenoxy), a substituted or unsubstituted alkoxycarbonyl group (preferably an alkoxycarbonyl group having from 2 to 10 carbon atoms, e.g., methoxycarbonyl, ethoxycarbonyl, propoxycarbnyl, nonyloxycarbonyl, phenoxycarbonyl, and 2-hydroxyethyloxycarbonyl), a substituted or unsubstituted acyl group (preferably an acyl group having from 1 to 10 carbon atoms, e.g., formyl, acetyl, propionyl, benzoyl, and cyanocarbonyl), a substituted or unsubstituted carbamoyl group (e.g., $—CONH_2$, $—CONHCH_3$, $—CONHC_2H_5$, $—CON(CH_3)_2$, $—CONHC_6H_{13}$, and —CONHPh {wherein Ph represents a phenyl group and so forth}), a substituted or unsubstituted mercapto group (e.g., hydrothio, methylthio, ehylthio, butylthio, octylthio, and phenylthio), a substituted or unsubstituted amino group (e.g., $—NH_2$, $—NHCH_3$, $—N(CH_3)_2$, $—N(CH_3)Ph$, $—NHCOCH_3$, $—NHSO_2C_5H_{11}$, and $—NHSO_2Ph$), a substituted or unsubstituted sulfonyl group (e.g., $—SO_2CH_3$, $—SO_2CH_2CH_2CH_3$, $—SO_2NH_2$, $—SO_2NHCH_3$, $—SO_2N(CH_3)_2$, $—SO_2NHC_6H_{13}$, and $—SO_2NHPh$), a substituted or unsubstituted alicyclic group (preferably an alicyclic group having from 3 to 10 carbon atoms, e.g., cyclopentyl, cyclohexyl, cycloheptyl, cyclohexenyl, and menthyl), a substituted or unsubstituted aromatic group (e.g., phenyl, naphthyl, pyridyl, and thienyl), or a substituted or unsubstituted heterocyclic group (e.g., tetrahydrofuryl, pyrrolidyl, piperidyl, morpholyl, and indolyl).

Also, $R_1$ and $R_2$ may form together a 5-membered ring, a 6-membered ring, a 7-membered ring, etc., or an aromatic ring (e.g., a benzene ring). In this case, the foregoing 5- to 7-membered rings or the aromatic ring may contain a hetero atom such as nitrogen, oxygen, sulfur, etc., and examples of these rings are a morpholine ring, a pyridine ring, a thiadiazole ring, a quinoline ring, an isoquinoline ring, a pyrazine ring and a pyrimidine ring.

As the substituent which may be substituted to the groups shown by $R_1$ and $R_2$ described above, there are, for example, a halogen atom, a hydroxy group, a carboxylic acid group or the salt thereof, a sulfonic acid group or the salt thereof, a cyano group, a nitro group, a substituted or unsubstituted alkyl group (preferably an alkyl group having from 1 to 5 carbon atoms, and the substituent thereof includes a halogen atom, a hydroxy group, a carboxylic acid group or the salt thereof, a sulfonic acid group or the salt thereof, an alkoxy group, an aromatic group, etc.), a substituted or unsubstituted alkoxy group (preferably an alkoxy group having from 1 to 5 carbon atoms, and the substituent thereof includes a halogen atom, a hydroxy group, a carboxylic acid group or the salt thereof, a sulfonic acid group or the salt thereof, an alkoxy group, an aromatic group, etc.), a substituted or unsubstituted alkylthio group (preferably an alkyl group having from 1 to 5 carbon atoms, and the substituent thereof includes a halogen atom, a hydroxy group, a carboxylic acid group or the salt thereof, a sulfonic acid group or the salt thereof, an alkoxy group, an aromatic group, etc.), a substituted or unsubstituted aromatic group (the substituent thereof includes a halogen atom, a hydroxy group, a nitro group, a carboxylic acid group or the salt thereof, a sulfonic acid group or the salt thereof, a cyano group, an alkyl group, an alkoxy group, an aromatic group, an acyl group, an alkoxycarbonyl group, an alkyl-substituted carbamoyl group, an alkyl-substituted sulfonamido group, an acyl-substituted amino group, etc.), a substituted or unsubstituted alkoxycarbonyl group (e.g., methoxycarbonyl, ethoxycarbonyl, propoxycarbonyl, nonylcarbonyl, phenoxycarbonyl, and 2-hydroxyethyloxycarbonyl), a substituted or unsubstituted carbamoyl group (the substituent includes an alkyl group, an aromatic group, etc.), a substituted or unsubstituted sulfonyl group (the substituent includes an alkylamino group, etc.), a substituted or unsubstituted amino group (the substituent includes an alkyl group, a hydroxyalkyl group, an acyl group, an alkylsulfonyl group, etc.), etc.

Then, the 2,1,3-benzothiadiazole compound shown by formula (II) is explained in detail.

In formula (II), $R_3$, $R_4$, $R_5$, and $R_6$ each independently represents a hydrogen atom, a halogen atom (e.g., fluorine, chlorine, bromine, and iodine), a hydroxy group, a cyano group, a carboxy group or the salt thereof, a sulfoxy group or the salt thereof, a substituted or unsubstituted alkyl group (preferably an alkyl group having from 1 to 10 carbon atoms, e.g., methyl, ethyl, propyl, isopropyl, butyl, tert-butyl, hexyl, octyl, and decyl), a substituted or unsubstituted alkenyl group (preferably an alkenyl group having from 2 to 10 carbon atoms, e.g., vinyl, allyl, butenyl, octenyl, and 1-butyl-4-hexenyl), a substituted or unsubstituted alkynyl group (preferably an alkynyl group having from 2 to 10 carbon atoms, e.g., propargyl, hexynyl, and octynyl), a substituted or unsubstituted alkoxy group (preferably an alkoxy group having from 1 to 10 carbon atoms, e.g., methoxy, ethoxy, isopropoxy, butoxy, decyloxy, allyloxy, and phenoxy), a substituted or unsubstituted alkoxycarbonyl group (preferably an alkoxycarbonyl group having from 2 to 10 carbon atoms, e.g., methoxycarbonyl, ethoxycarbonyl, propoxycarbonyl, nonyloxycarbonyl, phenoxycarbonyl, and 2-hydroxyethyloxycarbonyl), a substituted or unsubstituted acyl group (preferably an acyl group having from 1 to 10 carbon atoms, e.g., formyl, acetyl, propionyl, benzoyl, and cyanocarbonyl), a substituted or unsubstituted carbamoyl group (e.g., $—CONH_2$, $—CONHCH_3$, $—CONHC_2H_5$, $—CON(CH_3)_2$, $—CONHC_6H_{13}$, and —CONHPh), a substituted or unsubstituted mercapto group (e.g., hydrothio, methylthio, ethylthio, butylthio, octylthio, and phenylthio), a substituted or unsubstituted thiocarbamoyl group (e.g., $—CSNH_2$, $—CSNHCH_3$, $—CSNHC_2H_5$, $—CSN(CH_3)_2$, $—CSNHC_6H_{13}$, and —CSNHPh), or a substituted or unsubstituted amino group (preferably the amino groups shown by following formula (VI)

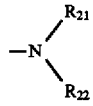

(VI)

wherein $R_{21}$ and $R_{22}$ in formula (VI), which may be the same or different, each represents a hydrogen atom, an alkyl group {preferably an alkyl group having from 1 to 10 carbon atoms, e.g., methyl, ethyl, propyl, isopropyl, butyl, tert-butyl, hexyl, nonyl, decyl, cyclopropyl, and cyclopropyl}, an alkenyl group {preferably alkenyl group having from 2 to 10 carbon atoms, e.g., vinyl, allyl, butenyl, octenyl, 1-butyl-4-hexenyl, and cyclohexenyl}, an alkynyl group {preferably an alkynyl group having from 2 to 10 carbon atoms, e.g., propargyl, hexynyl, and octynyl}, an aromatic group {preferably an aryl group having from 6 to 10 carbon atoms, e.g., phenyl, tollyl, and naphthyl}, a polyalkyleneoxy group {preferably a polyalkyleneoxy group having from 3 to 15 carbon atoms, e.g., polyethylene oxide and polypropylene oxide}, an amino group {e.g., $—NH_2$, $—NHCH_3$, $—N(CH_3)_2$, $—N(CH_3)Ph$, $—NHCOCH_3$, $—NHSO_2C_5H_{11}$, and $—NHSO_2Ph$}, an acyl group {preferably an acyl group having from 1 to 10 carbon atoms, e.g., formyl, acetyl, propionyl, octanoyl, acryloyl, and benzoyl}, a sulfonyl group {e.g., methanesulfonyl, ethanesulfonyl, butanesulfonyl, nonanesulfonyl, benzenesulfonyl, and toluenesulfonyl} or $R_{21}$ or $R_{22}$ may form a double bond with a carbon atom of the substituent of the amino group, such as an imino group {e.g., methylimino, dimethylimino, pentylimino, tolylimino, and pyridylimino} or the substituents of the amino group may combine each other to form a nitrogen-containing hetero ring of from a 3-membered ring to a 10-membered ring {e.g., an aziridine ring, a piperidine ring, a morpholine ring, and a piperazine ring}, and $R_{21}$ and $R_{22}$ of the amino group may be further substituted with other substituent such as a halogen atom {e.g., chlorine, bromine, and iodine}, a hydroxy group, a carboxylic acid group or the salt thereof, a sulfonic acid group or the salt thereof, an alkyl group, an alkenyl group, an alkynyl group, an aromatic group, an acyl group, an alkoxycarbonyl group, an amino group, a heterocyclic group, or an onium salt group containing at least one of a nitrogen atom, a sulfur atom, and a phosphorus atom {e.g., pyridinium, carbamoylpyridinium, quinolinium, triphenylphosphonium, and isothiourenium}), a substituted or unsubstituted sulfonyl group (e.g., $—SO_2CH_3$, $—SO_2CH_2CH_2CH_3$, $—SO_2NH_2$, $—SO_2NHCH_3$, $—SO_2N(CH_3)_2$, $—SO_2NHC_6H_{13}$, and $—SO_2NHPh$), a substituted or unsubstituted alicyclic group (preferably an alicyclic group having from 3 to 10 carbon atoms, e.g., cyclopentyl, cyclohexyl, cycloheptyl, cyclohexenyl, and menthyl), a substituted or unsubstituted aromatic group (e.g., phenyl, naphthyl, pyridyl, and thienyl), or a substituted or unsubstituted heterocyclic group (e.g., tetrahydrofuryl, pyrrolidyl, piperidyl, morpholyl, and indolyl).

Also, $R_3$, $R_4$, $R_5$, and $R_6$ may form together a 5-membered ring, a 6-membered ring, a 7-membered ring, etc., or an aromatic ring (e.g., a benzene ring). In this case, the 5- to 7-membered rings or the aromatic ring may contain therein a hetero atom such as a nitrogen atom, an oxygen atom, a sulfur atom, etc., (examples of these rings are a morpholine ring, a pyridine ring, a thiadiazole ring, a quinoline ring, an isoquinoline ring, a pyrazine ring, and a pyrimidine ring).

In this case, $R_3$, $R_4$, $R_5$, and $R_6$ may be substituted with a substituent such as a halogen atom, a hydroxy group, a carboxy acid group or the salt thereof, a sulfonic acid group or the salt thereof, a cyano group, a nitro group, a substituted or unsubstituted alkyl group (preferably an alkyl group having from 1 to 5 carbon atoms and the substituent thereof includes a halogen atom, a hydroxy group, a carboxylic acid group or the salt thereof, a sulfonic acid group or the salt thereof, an alkoxy group, an aromatic group, etc.), a substituted or unsubstituted alkoxy group (preferably an alkoxy group having from 1 to 5 carbon atoms and the substituent thereof includes a halogen atom, a hydroxy group, a carboxylic acid group or the salt thereof, a sulfonic acid group or the salt thereof, an alkoxy group, an aromatic group, etc.), a substituted or unsubstituted alkylthio group (preferably an alkylthio group having from 1 to 5 carbon atoms and the substituent includes a halogen atom, a hydroxy group, a carboxylic acid group or the salt thereof, a sulfonic acid group or the salt thereof, an alkoxy group, an aromatic group, etc.), a substituted or unsubstituted aromatic group (the substituent includes a halogen atom, a hydroxy group, a nitro group, a carboxylic acid group or the salt thereof, a sulfonic acid group or the salt thereof, a cyano group, an alkyl group, an alkoxy group, an aromatic group, an acyl group, an alkoxycarbonyl group, an alkyl-substituted alkoxy group, an alkyl-substituted sulfonamide group, an acyl-substituted amino group, etc.), a substituted or unsubstituted alkoxycarbonyl group (e.g., methoxycarbonyl, ethoxycarbonyl, propoxycarbonyl, nonyloxycarbonyl, phenoxycarbonyl, and 2-hydroxyethyloxycarbonyl), a substituted or unsubstituted carbamoyl group (the substituent includes an alkyl group, an aromatic group, etc.), a substituted or unsubstituted sulfonyl group (the substituent includes an alkylamino group, etc.), a substituted or unsubstituted amino group (the substituent includes an alkyl group, a hydroxyalkyl group, an acyl group, an alkylsulfonyl group, etc.), etc.

$R_7$, $R_8$, $R_9$, $R_{10}$, $R_{11}$, and $R_{12}$ of the compounds shown by formula (III), which are used in this invention, have the same significance as $R_3$, $R_4$, $R_5$, and $R_6$ in formula (II) described above.

There is no particular restriction on the divalent linkage group shown by $L_1$ in formula (III) but typical examples of the linkage group include a substituted or unsubstituted alkylene group (preferably an alkylene group having from 1 to 10 carbon atoms, e.g., methylene, ethylene, butylene, and octylene), a substituted or unsubstituted alkenylene group (preferably an alkenylene having from 3 to 10 carbon atoms, e.g., propenylene and hexenylene), a substituted or unsubstituted alkynylene group (preferably an alkynylene group having from 3 to 10 carbon atoms, e.g., propynylene and octynylene), and a substituted or unsubstituted arylene group (preferably an arylene group having from 6 to 10 carbon atoms, e.g., phenylene and naphthylene).

The substituent for the divalent linkage group shown by $L_1$ includes a hydroxy group, a halogen atom (e.g., chlorine, bromine, and iodine), an alkyl group (preferably an alkyl group having from 1 to 10 carbon atoms, e.g., methyl, ethyl, isopropyl, tert-butyl, hexyl, nonyl, and cyclohexyl), a carboxylic acid group or the salt thereof, a sulfonic acid group or the salt thereof, etc.

$R_{13}$, $R_{14}$, $R_{15}$, $R_{16}$, $R_{17}$, and $R_{18}$ of the compounds shown by formula (IV), which are used in this invention, have the same significance as $R_3$, $R_4$, $R_5$, and $R_6$ in formula (II) described above.

In formula (IV), $R_{19}$ and $R_{20}$, which may be the same or different, each represents a hydrogen atom, a substituted or unsubstituted alkyl group (preferably an alkyl group having from 1 to 10 carbon atoms, e.g., methyl, ethyl, propyl, isopropyl, butyl, tert-butyl, hexyl, nonyl, decyl, cyclopropyl, and cyclohexyl), a substituted or unsubstituted alkenyl group (preferably an alkenyl group having from 2 to 10 carbon atoms, e.g., vinyl, allyl, butenyl, octenyl, 1-butyl-4-hexenyl, and cyclohexenyl), a substituted or unsubstituted alkynyl group (preferably from 1 to 10 carbon atoms, e.g., propargyl, hexynyl, and octynyl), a substituted or unsubstituted aromatic group (preferably an aromatic group having from 6 to 10 carbon atoms, e.g., phenyl, tolyl, and naphthyl), a substituted or unsubstituted acyl group (preferably an acyl group having from 1 to 10 carbon atoms, e.g., formyl, acetyl, propionyl, octanoyl, acryloyl, and benzoyl), or a substituted or unsubstituted sulfonyl group (e.g., methanesulfonyl, ethanesulfonyl, butanesulfonyl, nonanesulfonyl, benzenesulfonyl, and toluenesulfonyl).

There is no particular restriction on the divalent linkage group shown by $L_2$ in formula (IV) but typical examples of the linkage group includes a substituted or unsubstituted alkylene group (preferably an alkylene group having from 1 to 10 carbon atoms, e.g., methylene, ethylene, butylene, and octylene), a substituted or unsubstituted alkenylene group (preferably an alkenylene group having from 3 to 10 carbon atoms, e.g., propenylene and hexenylene), a substituted or unsubstituted alkynylene group (preferably an alkynylene group having from 3 to 10 carbon atoms, e.g., propynylene and octynylene), a substituted or unsubstituted arylene group (preferably an arylene group having from 6 to 10 carbon atoms, e.g., phenylene and naphthylene), a substituted or unsubstituted xylylene group, a substituted or unsubstituted polyalkyleneoxy group (preferably a polyalkyleneoxy group having from 2 to 14 repeating units, e.g., $—(CH_2CH_2O)_{10}—CH_2CH_2—$ and $—\{CH(CH_3)CH_2O\}_7—CH(CH_3)CH_2—$), and the group shown by following formula (VII)

$$-(A_1)_m-L_3-(A_2)_n- \quad \text{(VII)}$$

wherein $L_3$ represents the same divalent linkage group as the divalent linkage group shown by $L_1$ in formula (III); $A_1$ and $A_2$ each independently represents a carbonyl group, an aminocarbonyl group, or a sulfonyl group; and m and n each represents 0 or 1 and m+n is 1 or 2.

Also, the substituent for the divalent linkage group shown by $L_2$ in formula (IV) is same as the substituent for the divalent linkage group shown by $L_1$ in formula (III).

Then, specific examples of the 1,2,5-thiadiazole compounds and the 2,1,3-benzothiadiazole compounds shown by formula (I), formula (II), formula (III), and formula (IV) are shown below but the invention is not limited to them.

I-1

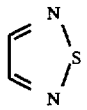

I-2

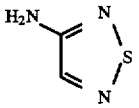

I-3

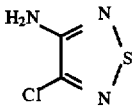

I-4

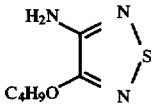

I-5

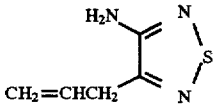

I-6

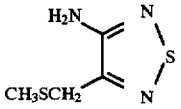

I-7

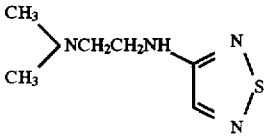

-continued

I-8

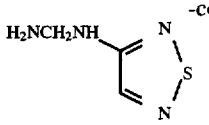

I-9

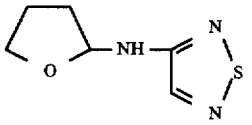

I-10

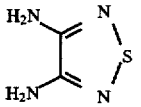

I-11

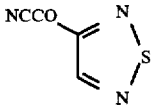

I-12

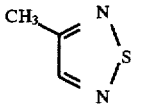

I-13

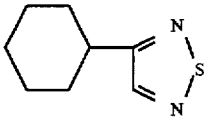

I-14

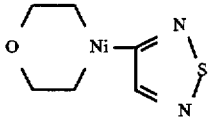

I-15

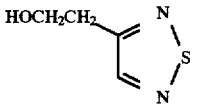

I-16

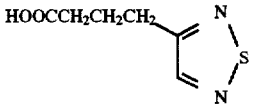

I-17

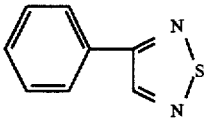

I-18

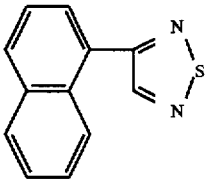

I-19

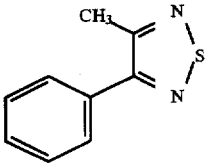

-continued
I-20
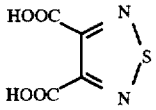
I-21
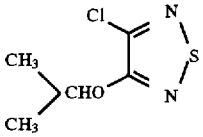
I-22
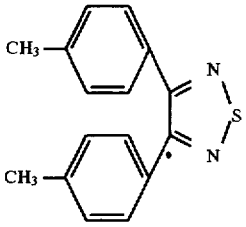
I-23
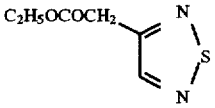
I-24
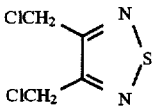
I-25
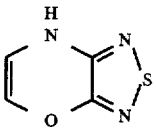
I-26
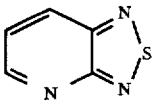
I-27
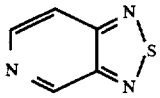
I-28
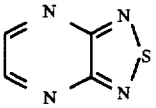
I-29
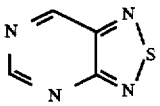
I-30
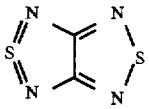
I-31
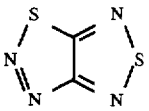
-continued
I-32
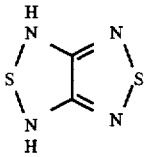
I-33
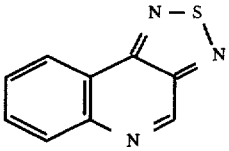
Specific examples of formula (II)
II-1
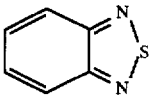
II-2
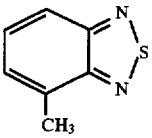
II-3
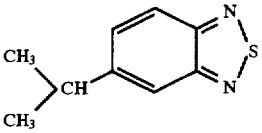
II-4
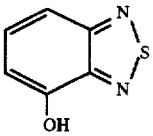
II-5
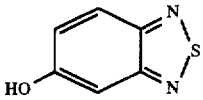
II-6
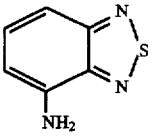
II-7
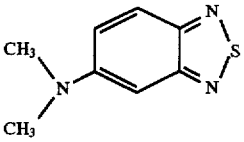
II-8
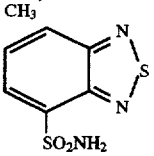
II-9
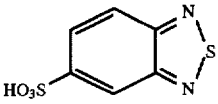

-continued
II-10
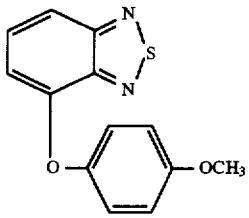
II-11
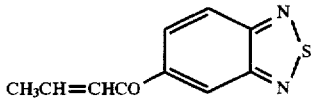
II-12
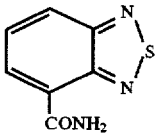
II-13
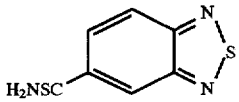
II-14
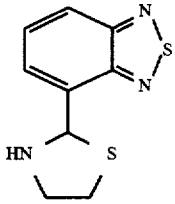
II-15
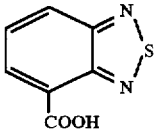
II-16
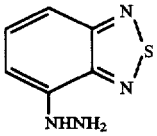
II-17
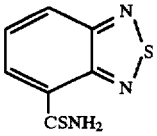
II-18
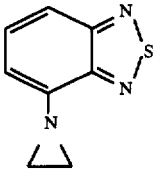
II-19
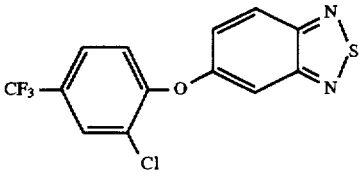
-continued
II-20
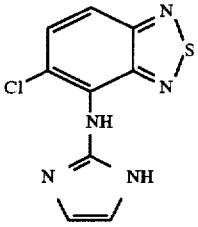
II-21
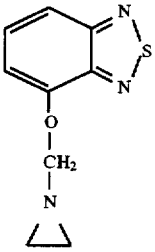
II-22
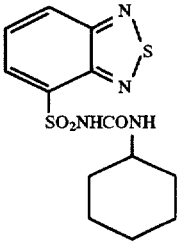
II-23
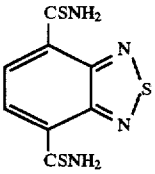
II-24
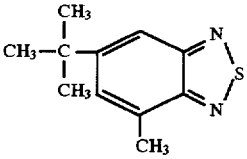
II-25
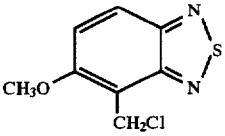
II-26
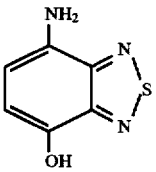
II-27
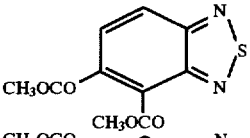
II-28
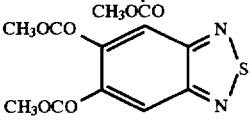

-continued
II-29
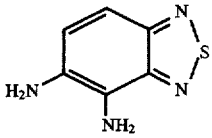
II-30
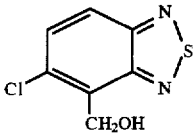
II-31
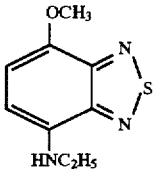
II-32
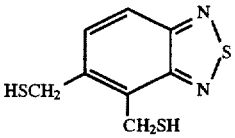
II-33
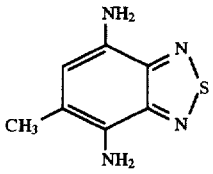
II-34
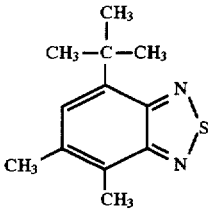
II-35
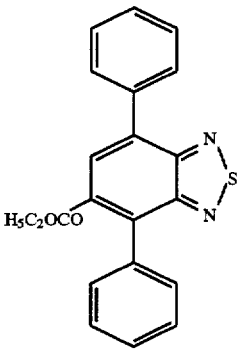
II-36
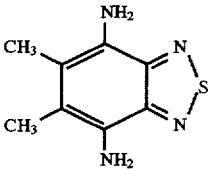
-continued
II-37
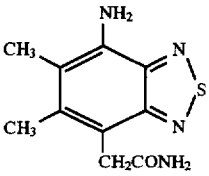
II-38
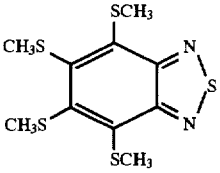
II-39
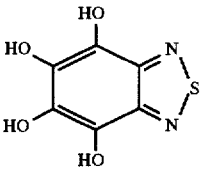
II-40
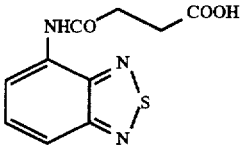
II-41
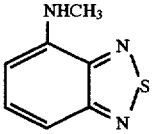
II-42
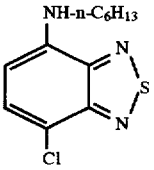
II-43
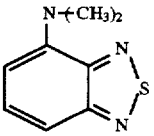
II-44
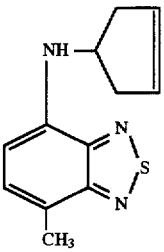
II-45
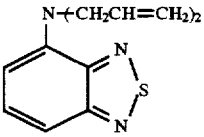

-continued
II-46
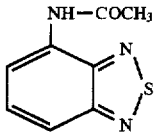
II-47
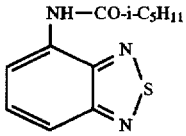
II-48
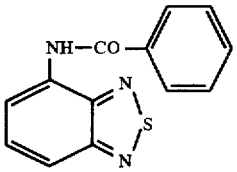
II-49
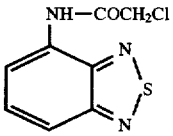
II-50
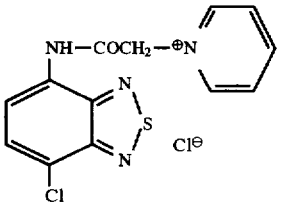
II-51
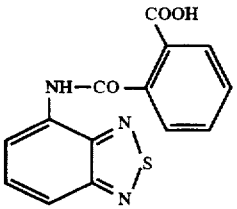
II-52
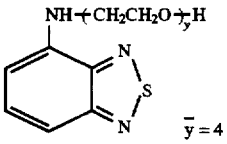
II-53
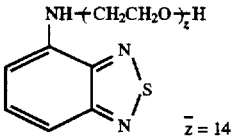
II-54
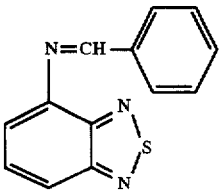
-continued
II-55
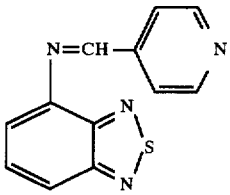
II-56
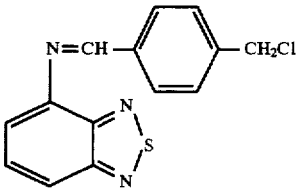
II-57
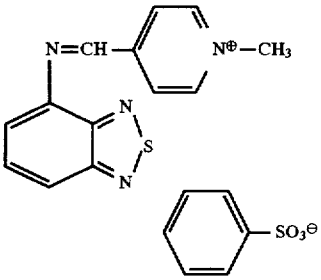
II-58
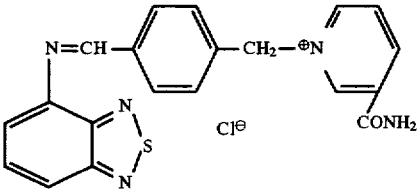
II-59
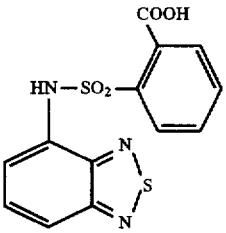
II-60
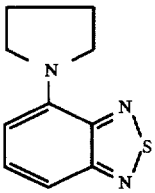
II-61
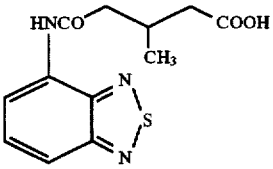

-continued

II-62

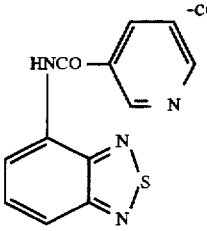

II-63

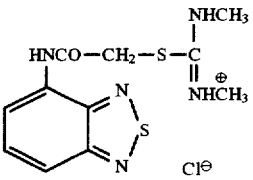

Specific examples of formula (III)

III-1

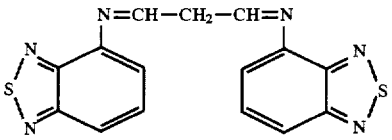

III-2

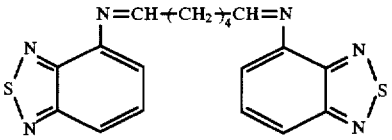

III-3

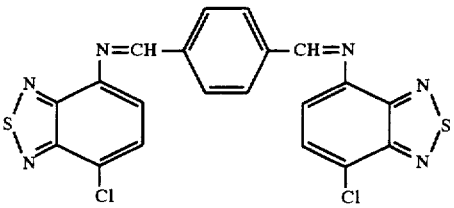

Specific examples of formula (IV)

IV-1

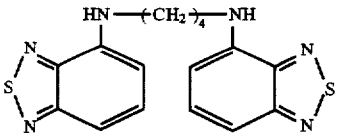

IV-2

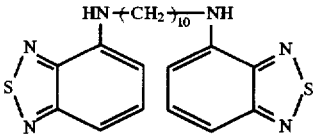

IV-3

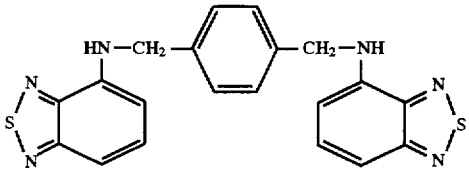

IV-4

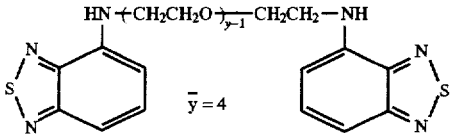

-continued

IV-5

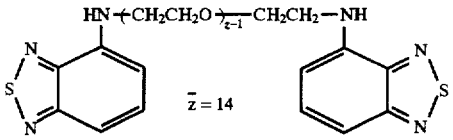

IV-6

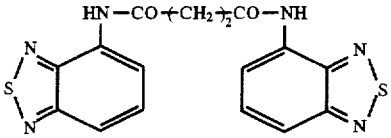

IV-7

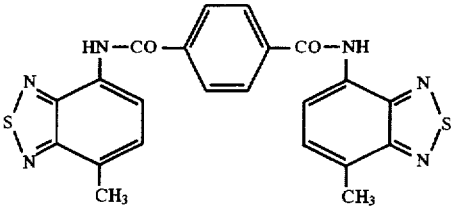

IV-8

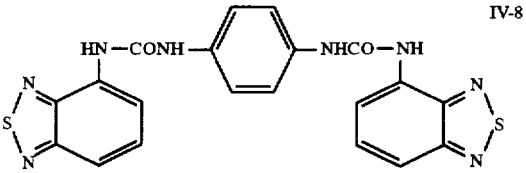

IV-9

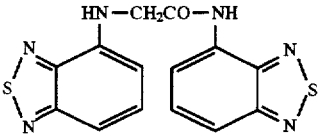

IV-10

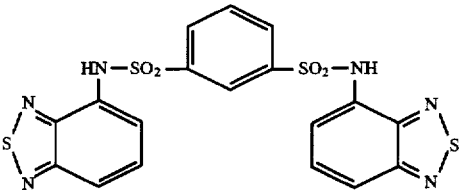

IV-11

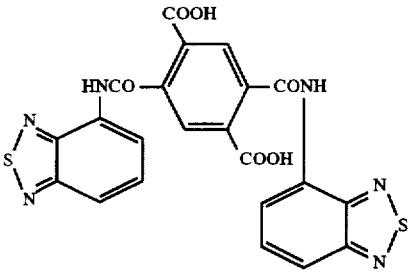

IV-12

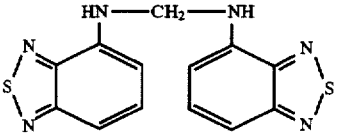

As the 1,2,5-thiadiazole compounds and the 2,1,3-benzothiadiazole compounds, which are used in this invention, commercially available reagents and industrial chemicals can be generally used and furthermore, the products synthesized according to the synthesis methods described in the following known literatures can be also used.

As the literatures describing the synthesis methods of the foregoing compounds are, for example, U.S. Pat. Nos. 2,983,730, 3,066,147, 3,279,909, 3,440,246, 3,501,285, 3,577,427, 4,544,400, and 4,555,521; Russian Patents 137, 118, 145,243, 168,706, 168,707, 169,941, 172,334, 176,588, 431,166, 515,748, 545,643, 595,317, 932,801, and 1,087, 521; German Patent Application (OLS) Nos. 1,925,989, 2,322,880, 2,404,858, and 3,012,837; (Old) East German Patent 134,184; British Patent 2,122,492; Dutch Patent 6,716,629; Swiss Patents 579,565 and 599,207; Austrian Patent 505,664; Belgian Patents 629,551 and 892,084; V. G. Pesin et al., *Zh. Obshch. Khim.*, 27, 1570 (1957); ibid., 32, 181 (1962); ibid., 33, 1746 and 1752 (1963); and ibid., 34, 1258, 1263, 1267, 1272, 1986, 2475, 3753, 3757, and 3763 (1964); V. G. Pesin et al., *Khim. Geterotsikl. Soedin., Akad. Nauk Latv.*, 1965, page 354; ibid., 1966, page 382; ibid., 1967, pages 97, 289, 666, and 1048; ibid., 1968, page 249; ibid., 1969, pages 613 and 619; and ibid., 1973, page 926; V. G. Pesin et al., *Latvijas PSR Zinatnu Akad. Vestis. Khim. Ser.*, 1965, pages 223 and 233; V. G. Pesin et al., i Izv. Vyssh. Uchebn. Zaved., Khim. Khim. Tekhnol., 20, 180 (1977); V. G. Pesin et al., *Zh. Org. Khim.*, 22, 421 (1986); K. S. Sharma et al., *Indian J. Chem. Sect. B*, 14B, 1001 (1976); ibid., 15B, 968 (1977); ibid., 16B, 892 (1978); ibid., 17B, 13 (1979); ibid., 18B, 556 (1979); ibid., 20B, 744 (1981); ibid., 21B, 65 (1982); ibid., 25B, 271 and 315 (1986); K. S. Sharma et al., *Synthesis*, 1983, page 581; I. A. Belen' Kaya et al., *Khim. -Farm. Zh.*, 12, 66 (1978); ibid., 13, 33 (1979); ibid., 18, 467 (1984); I. A. Belen' Kaya et al., *Fiziol. Akt. Veshchestva*, 18, 79 (1986); W. T. Smith, Jr., et al., *J. Org. Chem.*, 27, 676 (1962); R. S. Muravniket et al., *Tr. Leningr. Khim. -Farmatsevt, Inst.*, 1962, pages 176 and 184; J. B. Wright et al., *J. Org. Chem.*, 29, 1905 (1964); P. Hope et al., *J. Chem. Soc. C, Org.*, 1966, page 1283; L. M. Weinstock et al., *Tetrahedron Lett.*, 1966, page 2163, L. M. Weinstock et al., *J. Org. Chem.*, 32, 2823 (1967); H. Beecken, *Chem. Ber.*, 100, 2164 (1967); D. D. Monte et al., *Boll. Sci. Fac. Chim. Ind. Bologna*, 25, 3 (1967); J. J. Van Daalen et al., *Rec. Trav. Chim., Pays-Bas*, 86, 1159 (1967); B. Vincenzo et al., *Gazz. Chim. Ital.*, 97, 1614 (1967); B. Vincenzo et al., *Corsi. Semin. Chim.*, 1968, page 85; J. D. Bower et al., J. Am. Chem. Soc., 91, 6891 (1969); K. Pilgram et al., *J. Heterocycl. Chem.*, 7, 629 (1970); D. E. Bublitz et al., *J. Heterocycl. Chem.*, 9, 539 (1972); F. S. Mikhailitsyn at al., *Khim. Deterotsikl. Soedin.*, 1973, page 319; K. Pilgram et al., *J. Heterocycl. Chem.*, 11, 777 and 835 (1974); A. P. Komin et al., *J. Heterocycl. Chem.*, 12, 829 (1975); K. Pilgram et al., *J. Agric. Food Cehm.*, 23, 362 (1975); F. S. Mikhailitsyn et al., *Khim. Geterotsikl. Soedin.*, 1976, page 61; G. I. Eremeeva et al., *Khim. Geterotoskl. Soedin.*, 1976, page 340; B. Danylec et al., *J. Heterocycl. Cehm.*, 15, 537 (1978); T. Uno et al., *Chem. Pharm. Bull.*, 26, 3896 (1978); J. D. Warren et al., *J. Heterocycl. Chem.*, 16, 1617 (1979); M. Behforouz et al., *Tetrahedron Lett.*, 1979, page 4493; M. A. Kaldrikyan et al, *Sint. Geterotsikl. Soedin.*, 12, 7 (1981); P. S. Rao et al., *Indian J. Chem. Soct. B*, 20B, 111 (1981); A. Thomas et al., *Heterocycles*, 20, 1043 (1983); E. A. Bezzubets, *Khim.-Farm. Zh.*, 19, 1348 (1985); and R. Neidlein et al., *Chem Ber.*, 120, 1593 (1987).

That is, the 1,2,5-thiadiazole compounds and the 2,1,3-benzothiadiazole compounds for use in this invention can be synthesized according to or referring to the various methods described in these various literatures.

Then, specific synthetic methods of the typical compounds shown by formula (II), formula (III), and formula (IV), which can be used in this invention are described below.

Compound II-51 of the specific examples of the compound shown by formula (II) can be synthesized according to the synthesis scheme (1) described below.

[Synthesis Scheme (1)]

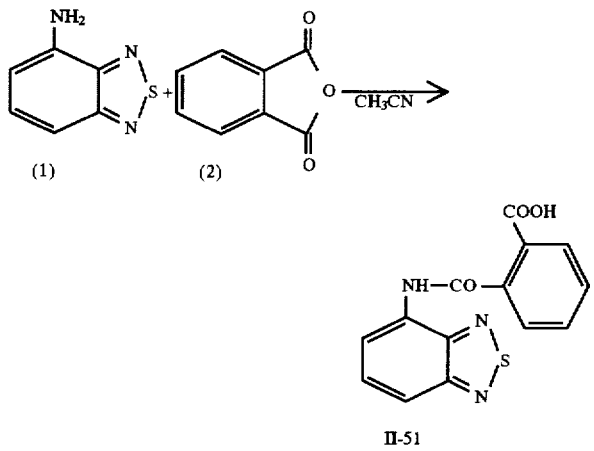

II-51

A mixture of 1.51 g (10 mmols) of 4-amino-2,1,3-benzothiadiazole (1), 1.48 g (10 mmols) of phthalic anhydride (2), and 85 ml of anhydrous acetonitrile was stirred with stirring at room temperature to carry out the reaction for one day. Crystals deposited during the reaction were collected by filtration and after washing the crystals with 15 ml of acetonitrile, the crystals were dried at room temperature to provide 1.95 g (yield 65.2%) of Compound II-51. The structure of Compound II-51 was confirmed by NMR, IR, and MS.

Compound III-3 of the specific examples of the compound shown by formula (III) can be synthesized according to synthesis scheme (2) described below.

[Synthesis Scheme (2)]

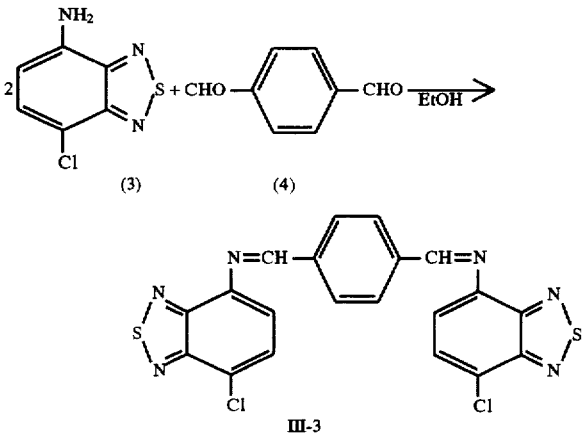

III-3

A mixture of 1.86 g (10 mmols) of 4-amino-7-chlloro-2,1,3-benzothiadiazole (3), 0.67 g (5 mmols) of terephthaladeliyde (4), and 30 ml of absolute ethanol was subjected to a reflux reaction at an external temperature of 100° C. for 8 hours. After cooling to room temperature, crystals deposited during the reaction were collected by filtration and after washing the crystals with 10 ml of ethanol, the crystals were dried at room temperature to provide 1.36 g (yield 57.9%) of Compound III-3. The structure of Compound III-3 was confirmed by NMR, IR, and MS.

Compound IV-4 of the specific examples of the compound shown by formula (IV) can be synthesized according to synthesis scheme (3) described below.

[Synthesis Scheme (3)]

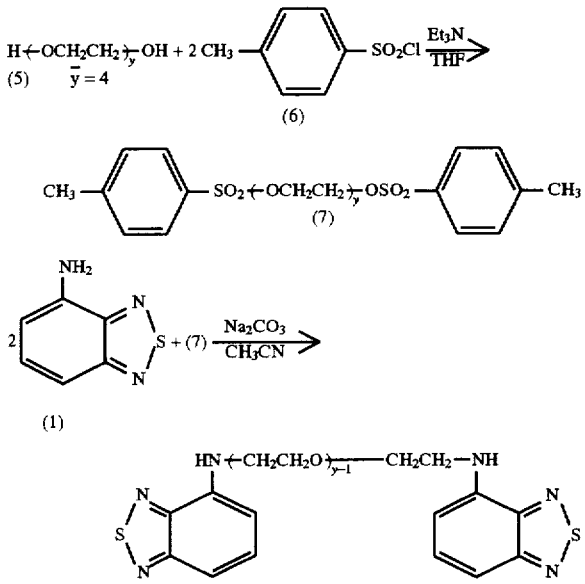

IV-4

A mixture of 2.00 g (10 mmols) of polyethylene glycol (PEG #200, average molecular weight 200) (5), 2.72 g (27 mmols) of triethylamine, and 10 ml of tetrahydrofuran was cooled to an inside temperature of 0° C. To the mixture was added dropwise 10 ml of a tetrahydrofuran solution of 4.77 g (25 mmols) of p-toluenesulfonyl chloride (6) at an inside temperature of not higher than 5° C. and thereafter, the reaction was carried out with stirring for one day at an inside temperature of not higher than 5° C. After the reaction was over, 35 ml of water was added to the reaction mixture and the mixture was extracted with 30 ml of dichloromethane. The dichloromethane layer thus obtained was washed with 10% hydrochloric acid and then water and after drying with anhydrous magnesium sulfate, the dichloroethane layer was dried up to provide 3.87 g (yield 76.1%) of compound (7). Then, 2.54 g (5 mmols) of compound (7) was mixed with 1.51 g (10 mmols) of compound (1), 1.06 g (10 mmols) of sodium carbonate, and 40 ml of acetonitrile and the reaction was carried out for 10 hours with stirring at an external temperature of 90° C. After cooling the reaction mixture to room temperature, the residue was removed by filtration, the extract obtained was dried up, the residue formed was dissolved in dichloromethane, and after washing with water, the solution was concentrated. The concentrate was separated and purified by a silica gel column chromatography (eluent: a mixture of methanol and ethyl acetate) to provide 0.94 g (yield 41.0%) of Compound IV-4. The structure of Compound IV-4 was confirmed by NMR, IR, and MS.

Then, embodiment (1) which is one of the preferred embodiments of the super high-contrast image forming process of this invention is explained.

The embodiment (1) of the present invention is an image forming process of obtaining super high-contrast images by development processing a previously image-exposed negative-working silver halide photographic material using an alkaline developer containing a reductone compound together with the 1,2,5-thiadiazole compound and/or the 2,1,3-benzothiadiazole compound as the essential component(s).

The 1,2,5-thiadiazole compound and/or the 2,1,3-benzothiadiazole compound which is the essential component in the present invention is contained in an alkaline developer containing a reductone compound as the developing agent in the preferred embodiment (1) of this invention.

The content of the 1,2,5-thiadiazole compound and/or the 2,1,3-benzothiadiazole compound, which is used in the present invention, is properly from 0.1 mg to 20 g, and preferably from 10 mg to 5 g per liter of the developer. Also, the 1,2,5-thiadiazole compounds and/or the 2,1,3-benzothiadiazole compounds, which are used in this invention, can be used singly or as a mixture thereof.

For adding the 1,2,5-thiadiazole compound and/or the 2,1,3-benzothiadiazole compound for use in this invention to the developer, the compound or the compounds may be directly added to the developer or may be added as a solution in water or an organic solvent miscible with water, such as alcohols, ketones, esters, amides, etc.

Then, the alkaline developer containing a reductone compound as the main developing agent, which is used in the embodiment (1) of this invention is explained below.

As the reductone compound which is used as the main developing agent for the alkaline developer being used in the embodiment (1) of the present invention, an endiol type compound, an enaminol type compound, an endiamine type compound, a thiol-enol type compound, and an enamine-thiol type compound are generally used. Specific examples of these compounds are described in U.S. Pat. No. 2,688,549 and JP-A-62-237443. The synthetic methods of these reductone compounds are well known and described in detail in, e.g., Danji Nomura and Hirohisa Oomura, *Reductone no Kagaku* (*Chemistry of Reductone*), published 1969, by Uchida Rokakuho.

In these compounds, the particularly preferred reductone compounds are the compounds shown by following formula (V):

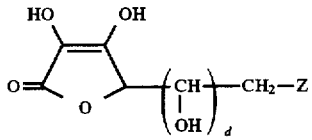

(V)

wherein Z represents a hydrogen atom or a hydroxy group and d is 0 or an integer of from 1 to 3.

Then, specific examples of the reductone compound being used in the present invention are illustrated below but the invention is not limited to these compounds.

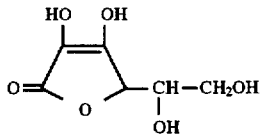

R-1

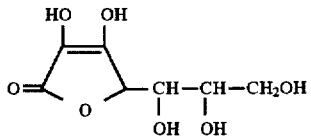

R-2

-continued

R-3

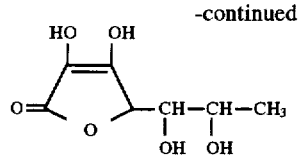

R-4

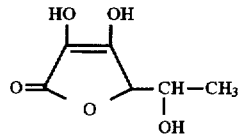

R-5

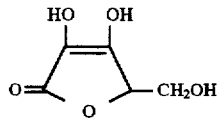

R-6

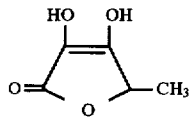

R-7

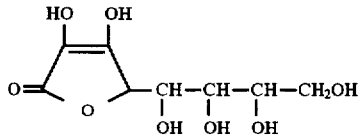

R-8

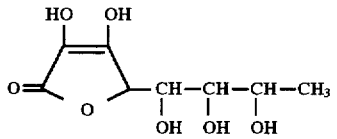

R-9

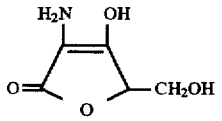

R-10

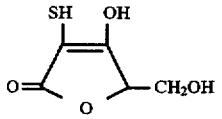

R-11

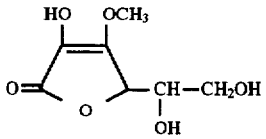

R-12

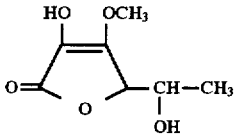

The reductone compound which is used as the main developing agent for the alkaline developer being used in the embodiment (1) of this invention can be used as the form of the alkali metal salt thereof, such as the lithium salt, the sodium salt, the potassium salt, etc. The addition amount of the reductone compound is preferably in the range of from 1 g to 200 g, and particularly from 10 g to 100 g per liter of the developer.

The alkaline developer containing the reductone compound as the main developing agent, which is used in the embodiment (1) of this invention, can contain dihydroxybenzenes (e.g., hydroquinonie, chlorohydroquinone, bromohydroquinone, isopropylhydroquinone, methylhydroquinone, 2,3-dichlorohydroquinone, 2,3-dibromohydroquinone, 2,5-dimethylhydroquinone, potassium hydrioquinonemonosulfonate, sodium hydroquinonemonosulfonate, catechol, and pyrazole), 3-pyrazolidones (e.g., 1-phenyl-3-pyrazolidone, 1-phenyl-4-methyl-3-pyrazlidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone,1,5-diphenyl-3-pyrazolidone, 1-p-tolyl-3-pyrazolidone, 1-phenyl-2-acetyl-4,4-dimehyl-3-pyrazolidone, 1-p-hydroxyphenyl-4,4-dimethyl-3-pyrazolidone, 1-(2-benzothiazolyl)-3-pyrazolidone, and 3-acetoxy-1-phenyl-3-pyrazolidolne), 3-aminopyrazolines (e.g., 1-(p-hydroxyphenyl)-3-aminopyrazoline, 1-(p-methylaminophenyl)-3-aminopyrazoline, and 1-(p-amino-m-methylphenyl)-3-aminopyrazoline), phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoneamidoethylaniline, and 3-methyl-4-amino-N-ethyl-N-β-methoxyethylaniline), and aminophenols (e.g., p-aminophenol, 3-methyl-p-aminophenol, N-methyl-p-aminophenol, 2,4-diaminophenol, N-(4-hydroxyphenyl) glycine, N-(β-hydroxyethyl)-2-aminophenol, 2-hydroxymethyl-p-aminophenol, and 2-hydroxymethyl-N-methyl-p-aminophenol) as an auxiliary developing agent in addition to the foregoing main developing agent. The foregoing compounds can be used as the hydrochlorides, the sulfates, etc., of these compounds. Also, these auxiliary developing agents may be used singly or as a mixture thereof.

The addition amount of the auxiliary developing agent is from 0.2 g to 20 g, and preferably from 0.5 g to 10 g per liter of the developer.

The alkaline developer which is used in the embodiment (1) of the present invention may further contain an antifoggant and as the antifoggant, inorganic antifoggants (e.g., sodium bromide, potassium bromide, and potassium iodide) and organic antifoggants (e.g., 1-phenyl-5-mercaptotetrazole, 5-nitroindazole, 6-nitroindazole, benzotriazole, benzimidazole, 2-mercaptobenzimidazole, and 5-methylbenzotriazole) described in Akira Sasai, *Shashin no Kagaku* (*Chemistry of Photography*), page 168, published 1982 by Shashin Kogyo Shuppan Sha; *Shashin Koogaku no Kiso, Ginen Shashin Hen* (*Basis of Photographic Engineering, Silver Salt Photograph*), page 326, edited by Nippon Shashin Gakkai, published 1979, Corona Sha); T. H. James, *The Theory of the Photographic Processes*, 4th Ed., page 396, published by Macmillan Pub. Co., Inc., 1979, etc.

For adding the antifoggant to the alkaline developer for use in this invention, the antifoggant may be directly added to the alkaline developer or may be added as a solution thereof in water or an organic solvent miscible with water, such as alcohols, ketones, esters, amides, etc.

The addition amount of the antifoggant for use in this invention is from 1 mg to 10 g, and preferably from 0.1 g to 5 g per liter of the developer.

The alkaline developer which is used in the embodiment (1) of this invention may further contain a borate compound and as the borate compound which is used for the developer, at least one kind of the compound selected from orthoboric acid, trioxyboric acid, potassium tetraborate, sodium tetraborate, ammonium metaborate, potassium metaborate, sodium metaborate, borax, etc., and the anhydrides of these compounds is used.

For adding the borate compound to the alkaline developer for use in this invention, the borate compound may be directly added to the alkaline developer or may be added as an aqueous solution thereof.

The addition amount of the borate compound which is used for the alkaline developer in this invention is from 1 g to 250 g, and preferably from 15 g to 100 g per liter of the developer.

It is desirable that the alkaline developer containing the 1,2,5-thiadiazole compound and/or the 2,1,3-benzothiadiazole compound being used in the embodiment (1) of this invention and the reductone compound as the main developing agent contains a preservative in addition to the essential components described above. As the preservative, sulfites can be used. As the sulfite, there are sodium sulfite, potassium sulfite, lithium sulfite, ammonium sulfite, sodium bisulfite, potassium bisulfite, potassium metabisulfite, etc.

The addition amount of the sulfite is preferably not more than 0.5 mole per liter of the developer.

As the alkali agent which is used for the alkaline developer for use in the embodiment (1) of this invention, usually water-soluble inorganic alkali metal salts (e.g., lithium hydroxide, sodium hydroxide, potassium hydroxide, sodium carbonate, sodium hydrogencarbonate, potassium carbonate, potassium hydrogencarbonate, and potassium tertiary phosphate) or organic amine compounds (e.g., butylamine, diethylamine, triethylamine, ethanolamine, dimethylethanolamine, triethanolamine, ethylenediamine, and pyridine) can be used.

The alkaline developer which is used in the embodiment (1) of this invention can further contain at least one kind of amine compounds, hydrazine compounds, and quaternary onium salt compounds for the purposes of increasing the sensitivity, increasing the contrast, or accelerating the development. Specific examples of them are the amine compounds described in JP-A-53-77616, JP-A-53-137133, JP-A-54-37732, JP-A-60-14959, JP-A-60-140340, JP-A-2-8833, JP-A-2-170155, JP-A-4-438, JP-A-4-5652, JP-A-4-5653, JP-A-4-6548, JP-A-4-114150, JP-A-4-212144, JP-A-4-122926, and JP-A-5-93977, U.S. Pat. No. 4,975,354, European Patent Application No. 518,352A1 and the amine compounds, the hydrazine compounds, the quaternary onium salt compounds, etc., described in JP-A-4-51143, JP-A-5-127286, JP-A-5-134337, JP-A-5-134357, JP-A-5-197057, JP-A-5-232616, etc.

Furthermore, for the alkaline developer which is used in the embodiment (1) of this invention, if necessary, a water-soluble salt (e.g., acetic acid and boric acid), a pH buffer (e.g., sodium tertiary phosphate, sodium carbonate, potassium carbonate, sodium metaborate, and lithium tetraborate), an organic solvent (e.g., ethylene glycol, diethylene glycol, and methyl cellosolve), a toning agent, a surface active agent, a defoaming agent, a hard water softener, etc., can be used in addition to the foregoing components in the ranges of not reducing the effects of this invention.

Although the invention is not limited to the following example, as a preferred example of the alkaline developer in the embodiment (1) of this invention for forming super high-contrast images, there is an alkaline developer composed of at least one kind of the 1,2,5-thiadiazole compounds and/or the 2,1,3-benzothiadiazole compounds, the main developing agent shown by formula (V) described above, an aminophenol compound as an auxiliary developing agent, an antifoggant, a borate compound and an alkali agent.

Then, the silver halide photographic material which is used in the preferred embodiment (1) of this invention is explained.

The silver halide photographic material being used in the embodiment (1) of this invention has at least one emulsion layer composed of a silver halide emulsion. There is no particular restriction on the halogen composition of the silver halide emulsion being used in this invention and for example, silver chloride, silver chlorobromide, silver iodobromide, silver iodobromochlkoride, etc., can be used. In this case, however, the content of silver iodide of the silver halide is preferably not higher than 5 mol %, and more preferably not higher than 3 mol %.

The silver halide grains for use in this invention can have a relatively broad grain size distribution but preferably have a narrow grain size distribution and in particular, a monodisperse silver halide emulsion wherein the grain sizes occupying 90% of the total silver halide grains are within ± 40% of the average grain size is preferred.

The average grain size of the silver halide grains which are used in this invention is preferably not larger than 0.7 μm, and particularly preferably not larger than 0.4 μm. Also, the silver halide grains may have a regular crystal form such as cubic, octahedral, etc., or may have an irregular crystal form such as sphere, tabular, a clam-form, etc.

The silver halide crystal being used in this invention may be composed of a uniform phase throughout the whole crystal or may be composed of a different phase between the inside and the surface layer thereof.

The silver halide grains for use in this invention can be prepared by an optional known method. That is, an acid method, a neutral method, an ammonia method, etc., may be used for preparing the silver halide grains and as the reaction system of a soluble silver salt and a soluble halide, a single jet method, a reverse mixing method, a double jet method, or a combination thereof may be used. When as one of the double jet methods, a pAg controlled double jet method (C.D.J. method), that is, a method of keeping a constant silver ion concentration (pAg) in a liquid phase of forming silver halide grains is used, monodisperse silver halide grains having a uniform crystal form and substantially uniform grain sizes can be obtained. Also, silver halide grains can be formed using a silver halide solvent such as ammonia, thioether, tetra-substituted thiourea, etc.

By the grain-forming method using the controlled double jet method or the silver halide solvent, a silver halide emulsion having a regular crystal form and a narrow grain size distribution can be easily formed and the method is an effective means for preparing the silver halide emulsion for use in the present invention.

In the case of preparing the silver halide emulsion for use in this invention, during the step of forming or physical ripening silver halide grains, a cadmium salt, an iridium salt, a rhodium salt, a rhenium salt, or a ruthenium salt or a complex salt thereof may co-exist in the system for increasing the contrast of the silver halide emulsion.

After forming the precipitation of or physical ripening the silver halide emulsion, usually soluble salts are removed and as a means for the purpose, a noodle washing method which is applied after gelling gelatin of the emulsion may be used or a flocculation method of utilizing an inorganic salt composed of a polyvalent anion (e.g., sodium sulfate and magnesium sulfate), an anionic surface active agent, an anionic polymer (e.g., polystyrenesulfonic acid, a β-naphthalenesulfonic acid-formalin condensate, and an aromatic sulfonic acid-formalin condensate), or a gelatin derivative (e.g., aliphatic acylated gelatin, aromatic acylated gelatin, and an aromatic carbamoylated gelatin) may be used.

The silver halide emulsion for use in this invention may be or may not be chemically sensitized. As a chemical sensitization method, a known method such as a sulfur sensitization method, a reduction sensitization method, a noble metal sensitization method, a selenium sensitization method, a tellurium sensitization method, etc., can be used and these methods can be used singly or as a combination thereof.

As a sulfur sensitizer, the sulfur compounds contained in gelatin as well as other various sulfur compounds such as thiosulfates, thioureas, thiazoles, rhodanines, etc., can be used. Specific examples of the sulfur sensitizer are described in U.S. Pat. Nos. 1,574,944, 2,278,947, 2,410,689, 2,728,668, 3,501,313, 3,656,955, etc.

As a reduction sensitizer, stannous salts, amines, formamidinesulfinic acid, silane compounds, etc., can be used. Specific examples thereof are described in U.S. Pat. Nos. 2,487,850, 2,518,698, 2,983,609, 2,983,610, 2,694,637, etc.

In the noble metal sensitization methods, a gold sensitization method is a typical method and in the method, a gold compound such as mainly a gold complex salt is used. The gold sensitizer may further contain a complex salt of other noble metal than gold, such as platinum, palladium, iridium, etc. Specific examples thereof are described in U.S. Pat. No. 2,448,060, British Patent 618,061, etc.

For the selenium sensitization method, as a selenium sensitizer, inorganic selenium compounds or organic selenium compounds can be used and specific examples of these compounds are described in U.S. Pat. Nos. 1,574,944, 1,602,592, 1,623,499, 3,297,446, 3,297,447, 3,320,069, 3,408,196, 3,408,197, 3,442,653, 3,420,670, and 3,591,385; JP-B-52-34491, JP-B-52-34492, JP-B-53-295, JP-B-57-22090; JP-A-59-180536, JP-A-59-185330, JP-A-59-181337, JP-A-59-187338, JP-A-59-192241, JP-A-60-150046, JP-A-60-151637, JP-A-61-246738, JP-A-5-11385, etc.

The tellurium sensitization method and a tellurium sensitizers are described in U.S. Pat. Nos. 1,623,499, 3,320,069, 3,772,031, 3,531,289, and 3,655,394; British Patents 235,211, 1,121,496, and 1,295,462; Canadian Patent 800,958; JP-A-5-11386, JP-A-5-11387, JP-A-11388, JP-A-5-11390, JP-A-5-11392, JP-A-5-11393, JP-A-5-19395, JP-A-5-45768, JP-A-5-45769, JP-A-5-45772, etc.

The silver halide emulsions for use in this invention may be spectrally sensitized using sensitizing dyes for having a photosensitivity in a desired photosensitive wavelength region. The sensitizing dyes for use include cyanine dyes, merocyanine dyes, complex cyanine dyes, complex merocyanine dyes, holopolar cyanine dyes, hemicyanine dyes, oxonol dyes, styryl dyes, and hemioxonol dyes. Particularly useful dyes are dyes belonging to cyanine dyes, merocyanine dyes, and complex merocyanine dyes. For these dyes can be applied ring ordinary utilized for cyanine dyes as basic heterocyclic ring. That is, pyrroline ring, oxazole ring, oxazoline ring, thiazole ring, thiazoline ring, pyrrole ring, selenazole ring, imidazole ring, tetrazole ring, pyridine ring, indole ring, benzoxazole ring, benzothiazole ring, benzoselenazole ring, benzimidazole ring, quinoline ring, etc., can be applied.

These sensitizing dyes may be use singly but may be used as a combination thereof for the purpose of giving a desired spectral sensitivity or of the super-color-sensitization. By adding a dye which does not have a spectral sensitization by itself or a material which does not substantially absorb visible light together with the sensitizing dye, the super-color-sensitization can be applied.

In this case, the sensitizing dye(s) may be added to the silver halide emulsion in any step before coating the silver halide emulsion. For example, the sensitizing dye(s) may be added during the formation of silver halide crystals, during physical ripening, during chemical ripening, or to a coating solution of the silver halide emulsion prepared for coating.

The addition amount of the sensitizing dye for use in this invention is preferably from $1\times10^{-6}$ mol to $1\times10^{-1}$ mol, and particularly preferably from $5\times10^{-5}$ mol to $1\times10^{-2}$ mol per mol of silver.

It is preferred that the amount of a binder contained in the silver halide emulsion layer for use in this invention is not more than 250 g per mol of the silver halide in the emulsion. As the binder, gelatin is most preferable but other hydrophilic colloids than gelatin can be also used. For example, hydrophilic polymers such as albumin, casein, a graft polymer of gelatin and other high-molecular compound, polyvinyl alcohol, polyacrylamide, etc., can be used.

The silver halide emulsions for use in this invention can contain various compounds for preventing the formation of fog during the production, the storage or photographic processing of the photographic light-sensitive material or stabilizing the photographic performance of the photographic light-sensitive material. Examples of these compounds are emulsion stabilizers (e.g., hydroxytetraazindene compounds such as 6-hydroxy-4-methyl-1,3,3a,7-tetraazindene, etc.), antifoggants (e.g., azoles, mercaptotriazines, thiocarbonyl compounds such as oxazolinethion, etc., azaindenes, benzenethiosulfonic acid, benzenesulfinic acid, and benzenesulfonic acid amide), various kinds of surface active agents (e.g., cationic surface active agents, anionic surface active agents, nonionic surface active agents, and amphoteric surface active agents), extenders (e.g., saponin), gelatin plasticizers (e.g., a copolymer of an acrylic acid ester), and photographic characteristics improving agents (e.g., amine compounds, hydrazine compounds, quaternary onium salt compounds, and polyalkylene oxides).

The silver halide photographic material for use in the present invention comprises a support having coated thereon at least one hydrophilic colloid layer containing the silver halide emulsion but may further have other light-insensitive hydrophilic colloid layers such as a protective layer, an interlayer, an antihalation layer, a filter layer, etc.

Also, the photographic emulsion layer(s) and other hydrophilic colloid layer(s) of the silver halide photographic material for use in this invention may contain inorganic or organic hardening agents. As the hardening agent, chromium salts (chrome alum, etc.), aldehydes (formaldehyde, glyoxal, etc.), N-methylol compounds (dimethylolurea, methyloldimethyl hydantoin, etc.), active halogen compounds (2,4-dichloro-6-hydroxy-s-triazine, muco-chloric acid, etc.), active vinyl compounds (1,3,5-triacryloyl-hexahydro-s-triazine, etc.), epoxy compounds, aziridine compounds, pyridinium salt series hardening agents, etc., can be used.

The photographic emulsion layer(s) and other hydrophilic colloid layer(s) of the silver halide photographic material for use in this invention may further contain various kinds of photographic additives, an antistatic agent, a coating aid agent, a sliding property improving agent, a matting agent, and a water-insoluble or sparingly soluble polymer latex (the homopolymer or copolymer of an alkyl acrylate, an alkyl methacrylate, acrylic acid, glycidyl acrylate, etc.), etc., for improving the dimensional stability of the photographic light-sensitive material in the range of not reducing the effects of this invention.

In the embodiment (1) of this invention for forming the super high-contrast images, since the developer contains the 1,2,5-thiadiazole compound and/or the 2,1,3-benzthiadiazole compound for use in this invention, it is unnecessary to incorporate specific material(s) for forming high-contrast images in the silver halide photographic material for the purpose of forming high-contrast images. However, the silver halide photographic material to which the alkaline developer for use in this invention is applied may contain therein a compound which is generally known to form high-contrast images by being added to a silver halide photographic material. It has been confirmed that when the silver halide photographic material containing the foregoing compound having such a contrast increasing action is developed with the developer for use in this invention, the developer for use in this invention shows an action of accelerating the contrast increasing reaction.

As the foregoing conventional specific materials for forming high-contrast images, there are the specific hydrazine derivatives (generally, acrylphenylhydrazine derivatives), the quaternary ammonium salt polymers, or the organic compounds having a negative reduction potential described in the term of [Background of the Invention] of the specification of this application can be used.

Also, as a matter of course, by incorporating the 1,2,5-thiadiazole compound and/or the 2,1,3-benzothiadiazole compound for use in this invention in the silver halide photographic material and developing the silver halide photographic material with the alkaline developer for use in this invention, good and high-contrast images can be obtained.

Moreover, the photographic emulsion layer(s) or other hydrophilic colloid layer(s) of the silver halide photographic material to which the developer in this invention is applied can contain at least one kind of amine compounds, hydrazine compounds, and quaternary onium salt compounds as a nucleation accelerating compound. Specific examples of these compounds are the amine compounds described as a development accelerator or an accelerator for a nucleating infectious development in JP-A-53-77616, JP-A-53-137133, JP-A-54-37732, JP-A-60-14959, JP-A-60-140340, JP-A-2-8833, JP-A-4-438, JP-A-4-5652, JP-A-4-5653, JP-A-4-6548, JP-A-4-114150, JP-A-4-212144, JP-A-4-122926, etc.; the amine compounds as "incorporated booster" described in JP-A-2-170155, JP-A-5-93977, and U.S. Pat. No. 4,975,354; the amine compounds, the hydrazine compounds, and the quaternary onium salt compounds, which are used for improving the photographic performance such as for providing photographic light-sensitive materials forming less black spots, photographic light-sensitive materials forming less fog, etc., described in JP-A-2-327402, pages 117 to 118, JP-A-4-51143, JP-A-5-127286, JP-A-5-134337, JP-A-5-134357, JP-A-5-197057, JP-A-5-232616, etc.

The contrast-increasing compounds, the nucleating compounds, and the nucleation accelerating compounds described above can be added to the silver halide photographic materials as a solution thereof in a proper water-soluble solvent such as, for example, alcohols (methanol, ethanol, propanol, a fluorinated alcohol, etc.), ketones (acetone, methyl ethyl ketone, etc.), dimethylformamide, dimethyl sulfoxide, methyl cellosolve, etc. Also, according to a well-known emulsion-dispersing method, the foregoing compound is dissolved in an oil such as dibutyl phthalate, tricresyl phosphate, glyceryl triacetate, diethyl phthalate, etc., or an auxiliary solvent such as ethyl acetate, cyclohexanone, etc., and the emulsified dispersion thereof may be prepared mechanically for use. Furthermore, the powder of the addition material can be dispersed in water by a ball mill, a colloid mill, or by the application of ultrasonic waves according to the method known as a solid dispersion method.

As the support for the silver halide photographic material for use in this invention, known supports such as cellulose triacetate films, cellulose diacetate films, nitrocellulose films, polystyrene films, polyethylene terephthalate films, papers, synthetic papers, composite sheet thereof (e.g., one or both surfaces of a paper or a film are coated with polyolefin, etc.), glass sheets, etc., can be used. In these supports, polyethylene terephthalate films are particularly preferably used. These supports may be subjected to a corona treatment by a known method or, if necessary, may be subjected to a subbing treatment by a known method. Also, for increasing the dimensional stability, that is, for preventing the change of the dimensions of the support by the change of a temperature or humidity, a waterproofing layer containing a vinylidene chloride series polymer may be formed on the support.

Then, the process of developing the previously image-exposed silver halide photographic material with the alkaline developer for use in this invention in the embodiment (1) of the present invention is explained.

The silver halide photographic material for use in this invention is image-exposed by a proper method according to the using purpose of the light-sensitive material, for example, using an apparatus, such as a camera, a light irradiating apparatus, an image setter, etc., and using a light source such as a natural light, a light of a lamp, a laser light, an electron beam, etc. Thereafter, the silver halide photographic material is developed with an alkaline developer containing the 1,2,5-thiadiazole compound and/or the 2,1,3-benzothiadiazole compound for use in this invention together with the reductone compound as the main developing agent. The developing temperature is selected from the range of from 18° C. to 50° C., and preferably from 20° C. to 40° C. Also, the developing time depends upon the developing temperature and the processing condition but is usually from 10 seconds to 10 minutes, and preferably from 15 seconds to 5 minutes.

The silver halide photographic material thus developed in this invention may be processed, if necessary, with an acidic solution such that the development does not further proceed. However, such a treatment with an acidic solution is not always necessary in the case that the photographic material is automatically transported and is directly fixed as the case of using an automatic processor. As the acidic stopping solution described above, a diluted acetic acid solution, a solution of potassium metabisulfite, or an acidic solution of chrome alum can be used. Furthermore, in this case, sodium sulfate for inhibiting swelling of the gelatin layers can be added to the acidic solution. The processing condition with the stopping bath is selected from the ranges of from 10° C. to 50° C. and from several seconds to several minutes.

As the fix solution which is used in this invention, a solution having a generally used formulation can be used. For example, the fix solutions described in, *Shashin Kogaku no Kiso, Ginen Shashin Hen* (*Basis of Photographic Engineering, Silver Salt Photography*), page 330 st seq., published 1979, Corona Sha, Akira Sasai, *Shashin no Kagaku* (*Chemistry of Photography*), page 320 st seq., published 1982, by Shahsin Kogyo Shuppan Sha; W. Thomas, Jr., *SPSE Handbook of Photographic Science and Engineering*, page 528, published 1973, by John Wiley & Sons Co., can be used.

As a fixing agent, thiosulfates, thiocyanates, as well as organic sulfur compounds which are known to have the effect as a fixing agent can be used. Also, as a fixing aid, acid agents (e.g., acetic acid and citric acid), preservatives (e.g., sodium sulfite), buffers (e.g., boric acid), and hardening agents (e.g., potassium alum, alum, and aluminum sulfate) can be used.

The fixing temperature is selected from the range of from 18° C. to 50° C., and preferably from 20° C. to 40° C. Also, the fixing time depends upon the fixing temperature and the processing condition but is usually from 10 seconds to 10 minutes, and preferably from 15 seconds to 5 minutes.

After fixing, the silver halide photographic material is usually washed with water and washing water for use in this invention may contain antifungal agents (e.g., the compounds described in Horiguchi, *Bokin Bobai no Kagaku* (*Antibacterial and Antifungal Chemistry*)), water washing accelerators (e.g. sulfites), chelating agents, surface active agents (e.g., anionic, nonionic, cationic, and amphoteric surface active agents), etc.

Water washing is carried out for almost completely removing the silver salts dissolved by fixing and the dyes in the photographic films and is preferably carried out in the ranges of from about 20° C. to 50° C. and from 10 seconds to 5 minutes.

Drying in the super high-contrast image-forming process by the embodiment (1) of the present invention is carried out in the range of from room temperature to 80° C. and the drying time can be properly changed according to the drying condition but is usually from 5 seconds to about a half day.

It is convenient to perform the processing steps of development-fix-wash-drying using a roller transporting type automatic processor which can continuous carry out the processing steps and the process of using the automatic processor is generally used as an effective means in the field of the art. The automatic processor is described in U.S. Pat. Nos. 3,025,779, 3,545,971, etc.

Then, the embodiment (2) of the present invention, that is, the high-contrast image forming process of image-exposing a negative-working silver halide photographic material containing the 1,2,5-thiadiazole compound and/or the 2,1,3-benzothiadiazole compound and then developing it with an alkaline developer containing the reductone compound as the developing agent is explained below.

In the embodiment (2) of the present invention, at least one kind of the 1,2,5-thiadiazole compounds and/or the 2,1,3-benzothiadiazole compounds shown by formula (I), formula (II), formula (III), and formula (IV), which is or are the essential component(s) in this invention is incorporated in the negative-working silver halide photographic material and the amount of the 1,2,5-thiadiazole compound and/or the 2,1,3-benzothiadiazole compound contained in the photographic light-sensitive material is preferably from $1\times10^{-7}$ mol to $1\times10^{-1}$ mol, and particularly preferably from $5\times10^{-4}$ mol to $3\times10^{-2}$ mol per mol of the silver halide contained in the photographic light-sensitive material.

The silver halide photographic material containing the 1,2,5-thiadiazole compound and/or the 2,1,3-benzothiadiazole compound can be produced by the same method of producing the silver halide photographic material described above in the embodiment (1) of this invention. That is, the preparation of silver halide crystals, various chemical sensitizations, spectral sensitizations, addition of various additives (emulsion stabilizers, antifoggants, hardening agents, extenders, polymer latexes, various kinds of surface active agents, nucleating agents, nucleation accelerators, contrast increasing agents, etc.), etc., can be carried out by the same manners as in the embodiment (1) described above except that the 1,2,5-thiadiazole compound and/or the 2,1,3-benzothiadiazole compound is added to the silver halide photographic material.

For adding the 1,2,5-thiadiazole compound and/or the 2,1,3-benzothiadiazole compound in this invention into the silver halide photographic material, the compound(s) may be directly added to the hydrophilic colloid layer of the silver halide photographic material or may be added thereto as a solution in a proper water-miscible organic solvent such as alcohols (e.g., methanol, ethanol, propanol, and fluorinated alcohols), ketones (e.g., acetone and methyl ethyl ketone), dimethyl formamide, dimethyl sulfoxide, methyl cellosolve, etc. Also, according to a well-known emulsion-dispersing method, the foregoing compound is dissolved in an oil such as dibutyl phthalate, tricresyl phosphate, glyceryl triacetate, diethyl phthalate, etc., or an auxiliary solvent such as ethyl acetate, cyclohexanone, etc., and the emulsified dispersion thereof may be prepared mechanically for use. Furthermore, the powder of the 1,2,5-thiadiazole compound and/or the 2,1,3-benzothiadiazole compound can be dispersed in water by a ball mill, a colloid mill, or by the application of ultrasonic waves according to the method known as a solid dispersion method.

In the case of incorporating the 1,2,5-thiadiazole compound and/or the 2,1,3-benzothiazole compound for use in this invention to the silver halide photographic material of this invention, it is preferred to incorporate the compound(s) in the hydrophilic colloid layer of the silver halide photographic material and it is particularly preferred to incorporate the compound(s) in the silver halide emulsion layer and/or the hydrophilic colloid layer adjacent to the silver halide emulsion layer.

The time of adding the 1,2,5-thiadiazole compound and/or the 2,1,3-benzothiadiazole compound for use in this invention may be an optional time during the steps of producing the silver halide photographic material. For example, in the case of adding to the silver halide emulsion, the compound (s) can be added in an optional time from the initiation of chemical ripening to the step before coating but it is preferred to add the compound(s) in an optional time after finishing chemical ripening and directly before coating.

The silver halide photographic material for use in the embodiment (2) of the present invention can be prepared by coating the silver halide emulsion layer and/or the hydrophilic colloid layer containing the 1,2,5-thiadiazole compound and/or the 2,1,3-benzothiadiazole compound in this invention on a support followed by drying.

As the developer which is used for developing the silver halide photographic material containing the 1,2,5-thiadiazole compound and/or the 2,1,3-benzothiazole compound in the embodiment (2) of the invention after image-wise exposure, an alkaline developer containing the reductone compound as the developing agent is used.

As the alkaline developer containing the reductone compound for use in the embodiment (2) of the invention, the developer obtained by removing the 1,2,5-thiadiazole compound and/or the 2,1,3-benzothiadiazole compound from the alkaline developer containing the 1,2,5-thiadiazole compound and/or the 2,1,3-benzothiadiazole compound described in the embodiment (1) of this invention is used. As a matter of course, the alkaline developer in the embodiment (1) can be used as the developer in the embodiment (2).

That is, for the alkaline developer containing the reductone compound as the developing agent for use in the embodiment (2) of this invention, various kinds of the reductone compounds such as the endiol type reductone compound, etc., can be used as the main developing agent and various auxiliary developing agents such as aminophenol compound, etc., can be used. Furthermore, for the alkaline developer in the embodiment (2), various kinds of antifoggants, borate compounds, preservatives, alkali agents, amine compounds, hydrazine compounds, quaternary onium salt compounds, and other additives (acids, pH buffers, organic solvents, toning agents, surface active agents, defoaming agents, hard water softeners, etc.) as used for the developer in the embodiment (1) can be used. Also, the addition amounts of these additives are the same as those in the case of the developer in the embodiment (1).

An preferred example of the alkaline developer containing the reductone compound as the developing agent for use in the embodiment (2) of this invention is an alkaline developer containing at least the main developing agent shown by formula (V) described above, an aminophenol compound as an auxiliary developing agent, an antifoggant, a borate compound, and an alkali agent.

In the embodiment (2) of the invention, the processing process of obtaining super high-contrast negative images by developing the silver halide photographic material containing the 1,2,5-thiadiazole compound and/or the 2,1,3-benzothiadiazole compound for use in this invention can be carried out by the same process as in the embodiment (1).

That is, after image-exposing the silver halide photographic material, the processes of development-fix-wash-drying for the photographic light-sensitive material can be carried out using the same processing chemicals and under the same processing conditions as in the embodiment (1) described above.

In the embodiment (2), the use of the roller-transporting automatic processor which can continuously carry out these processing process is also convenient and the use of the automatic processor is generally employed as an effective means in the field of the art.

Then, the following examples are intended to illustrate the present invention more practically but not to limit the invention in any way.

EXAMPLE 1

After exposing each of commercially available photographic films FA and SFA (trade names, manufactured by Fuji Photo Film Co., Ltd.) and UFZ and CGP (trade names, manufactured by Eastman Kodak Company) to a tungsten light source of 2666K using an LB-200 filter, through a step wedge having a stage difference of 0.15 for 5 seconds, the film was developed in developer 1 (comparative developer) or developer 2 (the developer of the invention) for 120 seconds at 35° C., stopped, fixed, washed with water, and dried.

| Composition of Developer 1 (Comparative) | |
|---|---|
| N-Methyl-para-aminophenol · ½ sulfate | 7.5 g |
| Ascorbic Acid (Reductone Compound R-1) | 30.0 g |
| Potassium Bromide | 1.0 g |
| Potassium Metaborate.4/3 hydrate | 54.0 g |
| Water to make | 1.0 liter |
| pH adjusted with aqueous 5% sulfuric acid solution | 9.2 |
| **Composition of Developer 2 (the invention)** | |
| p-Aminophenol | 7.0 g |
| Ascorbic Acid (Reductone Compound R-1) | 30.0 g |
| Potassium Bromide | 1.0 g |
| Sodium Metaborate · tetra-hydrate | 70.0 g |
| 2,1,3-Benzothiadiazole (Compound II-1) | 0.5 g |
| 5-Nitroindazole | 8.0 mg |
| Water to make | 1.0 liter |
| pH adjusted with aqueous 5% sulfuric acid solution | 9.2 |

The results obtained are shown in Table 1 below.

TABLE 1

| Film | Photographic Characteristics | Developer 1 (Comparative) | Developer 2 (Invention) |
|---|---|---|---|
| FA | Fog | 0.06 | 0.06 |
| | Relative Sens. | 100 | 200 |
| | Gamma | 9 | 12 |
| | Pepper | A | A |
| SFA | Fog | 0.04 | 0.04 |
| | Relative Sens. | 100 | 332 |
| | Gamma | 6 | 19 |
| | Pepper | A | A |
| UFZ | Fog | 0.05 | 0.05 |
| | Relative Sens. | 100 | 436 |
| | Gamma | 5 | 29 |
| | Pepper | A | A |
| CGP | Fog | 0.05 | 0.05 |
| | Relative Sens. | 100 | 371 |
| | Gamma | 7 | 14 |
| | Pepper | A | A |

Relative Sens.: The relative sensitivity in Table 1 is a relative value of the reciprocal of the exposure amount of obtaining a density of 3.0 excluding the fog and the sensitivity of the case of developing each film with Developer 1 (comparative) for 120 seconds at 35° C. is shown as 100.

The gamma shows the average gradient between black densities 0.5 and 3.0 excluding fog and the fog shows the density at the unexposed portion. The pepper is the result of observing the unexposed portion of each film by a magnifying lens of 50 magnifications and evaluated in 5 grades, wherein A shown the best quality (substantially no pepper) and E shows the worst quality. A and B are suitable for practical use, C is a low quality but is barely in an allowable range for practical use, and D and E are unsuitable for practical use.

As is clear from Table 1, it can be seen that in the case of developing using Developer 2 containing 2,1,3-benzothiadiazole (Compound II-1) for use in this invention, each of the commercially available films shows a remarkable sensitivity increase and high contrast. However, in the case of developing with Developer 1 (comparative), each film does not show such a sensitivity increase and high contrast. In addition, pepper is not observed in each film.

As described above, it can be seen that by using Developer 2 in this invention, good high-contrast images having no occurrence of pepper and less fog are obtained from each of the commercially available films.

EXAMPLE 2

After exposing each of commercially available films LS5500 (trade name, manufactured by Fuji Photo Film Co., Ltd.) and SAI and ESY (trade names, manufactured by Eastman Kodak Company) using a sensitometer MARK-VII (trade name, manufactured by EG & G Co.) while contacting a step wedge having a stage difference of 0.15 for $1\times10^{-5}$ second, each film was developed with Developer 1 (Comparative) described in Example 1 or Developer 3 (the Invention) having the following composition for 120 seconds at 35° C., stopped, fixed, washed with water, and dried.

| Composition of Developer 3 (Invention) | |
|---|---|
| N-Methyl-para-aminophenol · ½ sulfate | 7.5 g |
| Ascorbic Acid (Reductone Compound R-1) | 30.0 g |

-continued

| Composition of Developer 3 (Invention) | |
|---|---|
| Potassium Bromide | 1.0 g |
| Sodium Metaborate · tetra-hydrate | 70.0 g |
| 4-Amino-2,1,3-benzothiadiazole (Compound II-6) | 0.5 g |
| 5-Nitroindazole | 30.0 mg |
| Water to make | 1 liter |
| pH adjusted with aqueous 5% sulfuric acid solution | 9.3 |

The results obtained are shown in Table 2 below.

TABLE 2

| Film | Photographic Characteristics | Developer 1 (Comparative) | Developer 3 (Invention) |
|---|---|---|---|
| LS5500 | Fog | 0.05 | 0.05 |
| | Relative Sens. | 100 | 219 |
| | Gamma | 7 | 29 |
| | Pepper | A | A |
| SAI | Fog | 0.05 | 0.05 |
| | Relative Sens. | 100 | 300 |
| | Gamma | 6 | 31 |
| | Pepper | A | A |
| ESY | Fog | 0.05 | 0.05 |
| | Relative Sens. | 100 | 289 |
| | Gamma | 6 | 16 |
| | Pepper | A | A |

Compound 1:

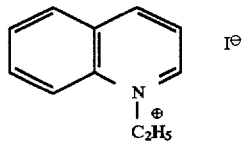

Compound 2:

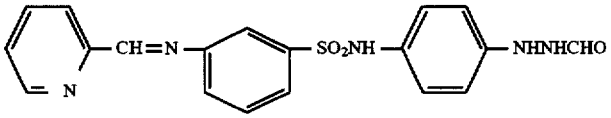

The relative sensitivity, fog, gamma, and pepper have the same meanings as in Table 1.

As is clear from Table 2, it can be seen that in the case of developing using Developer 3 containing 4-amino-2,1,3-benzothiadiazole (Compound II-6) for use in this invention, each of the commercially available films shows a remarkable sensitivity increase and a super high-contrast having a gamma of higher than 15. However, in the case of developing Developer 1 (comparative), each film does not show such a sensitivity increase and a high contrast. In addition, each film does not show pepper.

As described above, it can be seen that by using Developer 3 in this invention, good high-contrast images having no occurrence of pepper and less fog are obtained using various commercially available films for laser exposure.

EXAMPLE 3

By simultaneously adding an aqueous silver nitrate solution and an aqueous solution of a mixture of potassium bromide and sodium chloride (Br:Cl=30:70 by mol ratio) containing sodium rhodium(III) hexachloride in an amount of $1.5\times10^{-7}$ mol per mol of silver to an aqueous gelatin solution kept at 40° C. over a period of 75 minutes, a cubic monodisperse silver chlorobromide emulsion (AgCl 70 mol %) having an average grain size of 0.18 μm was prepared. After removing soluble salts by an ordinary method, $2.5\times10^{-5}$ mol of sodium thiosulfate and $1.6\times10^{-5}$ mol of chloroauric acid tri-hydrate ($HAuCl_4.3H_2O$) per mol of the silver halide were added to the silver halide emulsion and chemical ripening was carried out for 100 minutes at 50.0° C. The emulsion contained 80 g of gelatin per mol of the silver halide. To the emulsion thus prepared were further added $1\times10^{-3}$ mol of potassium iodide and $1.2\times10^{-2}$ mol of 6-hydroxy-4-methyl-1,3,3a,7-tetraazaindene per mol of the silver halide. The emulsion was split into 3 parts to provide (1) the portion being added nothing, (2) the portion to which $3\times10^{-3}$ mol of Compound 1 shown below was added per mol of the silver halide, and (3) the portion to which $3\times10^{-3}$ mol of Compound 2 shown below was added per mol of the silver halide. Then, each portion of the emulsion was coated on a polyethylene terephthalate (PET) base at a silver coverage of 40 mg/100 $cm^2$. Each emulsion layer was protected with a gelatin protective layer containing formalin and dimethylolurea as hardening agents to provide Film No. 1 (no addition), Film No. 2 (Compound 1 added), and Film No. 3 (Compound 2 added).

After exposing each of vhe film samples thus prepared by a tungsten light source of 2666K using an LB-200 filter through a step wedge having a stage difference of 0.15 for 5 seconds, each film was developed with Developer 1 (Comparative) in Example 1 or Developer 4 (the Invention) having the composition shown below for 60 seconds at 35° C., stopped, fixed, washed with water, and dried.

| Composition of Developer 4 (Invention) | |
|---|---|
| N-Methyl-para-aminophenol · ½ sulfate | 7.5 g |
| Ascorbic Acid (Reductone Compound R-1) | 30.0 g |
| Potassium Bromide | 1.0 g |
| Potassiuin Metaborate · 4/3 hydrate | 54.0 g |
| 2,1,3-benzothiadiazole (Compound II-1) | 0.5 g |
| Water to make | 1.0 liter |
| pH adjusted with aqueous 5% sulfuric acid solution | 9.2 |

The results obtained are shown in Table 3 below.

TABLE 3

| Film | Photographic Characteristics | Developer 1 (Comparative) | Developer 4 (Invention) |
|---|---|---|---|
| 1 | Fog | 0.04 | 0.04 |
| | Relative Sens. | 22 | 100 |

TABLE 3-continued

| Film | Photographic Characteristics | Developer 1 (Comparative) | Developer 4 (Invention) |
|---|---|---|---|
| | Gamma | 5.2 | 26.3 |
| | Pepper | A | A |
| 2 | Fog | 0.05 | 0.05 |
| | Relative Sens. | 98 | 186 |
| | Gamma | 14.7 | 19.7 |
| | Pepper | A | A |
| 3 | Fog | 0.04 | 0.04 |
| | Relative Sens. | 28 | 126 |
| | Gamma | 5.1 | 17.6 |
| | Pepper | A | A |

The relative sensitivity, the gamma, the fog, and the pepper have the same meanings as in Table 1 except that in the relative sensitivity, the sensitivity of the case of developing the Film No. 1 with Developer 4 (Invention) for 60 seconds at 35° C. is shown as 100.

As is clear from Table 3, in the case of developing with Developer 4 containing 2,1,3-benzothiadiazole (Compound II-1) for use in this invention, Film No. 1 which does not contain the specific compound causing the increase of contrast in the film shows the remarkable sensitivity increase and the super high-contrast having a gamma of higher than 15. Also, it can be seen that in the film containing the hydrazine type nucleating agent as Film No. 3, in the case of developing with Comparative Developer 1, the sensitivity increase and the increase of contrast by the hydrazine type nucleating agent are not observed owing to the low pH of the developer but in the case of developing with the developer added with 2,1,3-benzothiadiazole according to the invention, the remarkable sensitivity increase and the super high-contrast are obtained. Furthermore, it can be seen that in the film added with the quinolinium type nucleating agent as Film No. 2, by adding 2,1,3-benzothiadiazole to the developer, far more increase of sensitivity and the high contrast are obtained. In addition, in each film, the formation of pepper was not observed.

As described above, it can be seen that good high-contrast images having no pepper and less fog are obtained by using Developer 4 according to this invention.

EXAMPLE 4

By simultaneously adding an aqueous silver nitrate solution and an aqueous solution of potassium bromide containing sodium rhodium(III) hexabromide in an amount of $3.0\times10^{-7}$ mol per mol of silver while keeping pAg at 7.0 over a period of 60 minutes, a cubic monodisperse silver bromide emulsion having an average grain size of 0.22 μm was prepared. After removing insoluble salts by an ordinary method, $2.5\times10^{-5}$ mol of sodium thiosulfate per mol of the silver halide was added to the emulsion and chemical ripening was carried out for 70 minutes at 60° C. The emulsion contained 80 g of gelatin per mol of the silver halide. After adding $1.2\times10^{31\ 2}$ mol of 6-hydroxy-4-methyl-1,3,3a,7-tetraazaindene per mol of the silver halide to the emulsion thus prepared, the emulsion was split into 3 parts to provide (1) the portion added nothing, (2) the portion to which $3\times10^{-3}$ mol of Compound 1 described above was added per mol of the silver halide, and (3) the portion to which $3\times10^{-3}$ mol of Compound 2 described above was added per mol of the silver halide. Each portion of the emulsion was coated on a polyethylene terephthalate (PET) base at a silver coverage of 40 mg/100 $cm^2$. Each emulsion layer was protected with a gelatin protective layer containing formalin and dimethylolurea as hardening agents to provide Film No. 4 (no addition), Film No. 5 (Compound 1 added), and Film No. 6 (Compound 2 added).

After exposing each of the film samples thus prepared by a tungsten light source of 2666K using an LB-filter through a step wedge having a stage difference of 0.15 for 5 seconds, each film was developed with Developer 1 (Comparative) described in Example 1 or Developer 5 (the Invention) having the following composition for 120 seconds at 35° C., stopped, fixed, washed with water, and dried.

| Composition of Developer 5 (Invention) | |
|---|---|
| N-Methyl-para-aminophenol · ½ sulfate | 7.5 g |
| Ascorbic Acid (Reductone Compound R-1) | 30.0 g |
| Potassium Bromide | 1.0 g |
| Potassium Metaborate · 4/3 hydrate | 54.0 g |
| 4-amino-2,1,3-benzothiadiazole (Compound II-6) | 0.5 g |
| 5-Nitroindazole | 24.0 mg |
| Water to make | 1.0 liter |
| pH | 10.3 |

The results of the photographic characteristics obtained are shown in Table 4 below.

TABLE 4

| Film No. | Photographic Characteristics | Developer 1 (Comparative) | Developer 5 (Invention) |
|---|---|---|---|
| 4 | Fog | 0.04 | 0.04 |
| | Relative Sens. | 26 | 100 |
| | Gamma | 5.2 | 16.3 |
| | Pepper | A | A |
| 5 | Fog | 0.04 | 0.04 |
| | Relative Sens. | 86 | 134 |
| | Gamma | 12.7 | 18.7 |
| | Pepper | A | A |
| 6 | Fog | 0.04 | 0.04 |
| | Relative Sens. | 76 | 116 |
| | Gamma | 9.1 | 17.6 |
| | Pepper | A | A |

In the Table 4, the relative sensitivity, the fog, the gamma, and the Pepper have the same meanings as in Table 1 except that the sensitivity of the case of developing Film No. 4 with Developer 5 (Invention) for 120 seconds at 35° C. is shown as 100.

As is clear from Table 4, it can be seen that in the case of developing using Developer 5 containing 4-amino-2,1,3-benzothiadiazole (Compound II-6) for use in this invention, each film shows the remarkable sensitivity increase and the super high-contrast having a gamma of higher than 15. In addition, each film has no pepper.

As described above, it can be seen that good high-contrast images having no pepper and less fog are obtained by using Developer 5 according to this invention.

EXAMPLE 5

After exposing the sample of Film No. 1 prepared in Example 3 by a tungsten light source of 2666K using an LB-200 filter through a step wedge having a stage difference of 0.15 for 5 seconds, the film sample was developed with Developer 6 having the following composition or the same developer added with each of the 2,1,3-benzothiadiazole compounds for use in this invention shown in Table 5 below for 40 seconds at 35° C., stopped, fixed, washed with water, and dried.

| Composition of Developer 6 | |
|---|---|
| N-Methyl-para-aminophenol · ½ sulfate | 7.5 g |
| Ascorbic Acid (Reductone Compound R-1) | 30.0 g |
| Potassium Bromide | 1.0 g |
| Potassium Metaborate · 4/3 hydrate | 54.0 g |
| Water to make | 1.0 liter |
| pH | 9.8 |

The results of the photographic characteristics obtained are shown in Table 5 below.

TABLE 5

| Test No. | Added Compound | Photographic characteristics | |
|---|---|---|---|
| 1 | none | Fog | 0.05 |
| | | Relative Sens. | 100 |
| | | Gamma | 5.2 |
| | | Pepper | A |
| 2 | II-40 | Fog | 0.05 |
| | Addition | Relative Sen. | 365 |
| | Amount | Gamma | 16.5 |
| | 1 g/liter | Pepper | A |
| 3 | II-51 | Fog | 0.05 |
| | Addition | Relative Sens. | 340 |
| | Amount | Gamma | 14.3 |
| | 1 g/liter | Pepper | A |
| 4 | II-52 | Fog | 0.05 |
| | Addition | Relative Sens. | 345 |
| | Amount | Gamma | 14.7 |
| | 1 g/liter | Pepper | A |
| 5 | IV-12 | Fog | 0.05 |
| | Addition | Relative Sens. | 400 |
| | Amount | Gamma | 18.0 |
| | 1 g/liter | Pepper | A |

In Table 5, the relative sensitivity, the fog, the gamma and the pepper have the same meaning as in Table 1 except that the sensitivity of the case of developing the film of Test No. 1 with Developer 6 for 40 seconds at 35° C. is shown as 100.

As is clear from Table 5, it can be seen that in the case of developing using the developer added with each of the 2,1,3-benzothiadiazole compounds for use in this invention, even in the film which does not contain any specific contrast increasing compound, the film shows a remarkable sensitivity increase and the high contrast having a gamma of higher than 14. In addition, each film has no pepper.

As described above, it can be seen that good high-contrast images having no pepper and less fog are obtained by using Developer 6 added with the 2,1,3-benzothiadiazole compound.

EXAMPLE 6

The silver halide emulsion prepared by the same method as in Example 3 until the addition of 6-hydroxy-4-methyl-1,3,3a,7-tetraazaindene was split into 6 small portions and after adding each of the compounds for use in the invention and the comparative example shown in Table 6 below to each of the split portions, each portion of the emulsion was coated on a polyethylene terephthalate (PET) base on which a subbing layer was previously coated at a silver coverage of 40 mg/100 $cm^2$. Each emulsion layer thus formed was protected with a gelatin protective layer containing formalin and dimethylolurea as hardening agents to provide films of Test Nos. 7 to 12.

TABLE 6

| Film No. | Added Compound | Added Amount (mmol/mol-Ag) |
|---|---|---|
| 7 (Comparative) | none | — |
| 8 (Comparative) | Comparative Compd. | 4 |
| 9 (Invention) | II-6 | 4 |
| 10 (Invention) | II-58 | 4 |
| 11 (Invention) | III-3 | 4 |
| 12 (Invention) | IV-4 | 4 |

Comparative Compound:

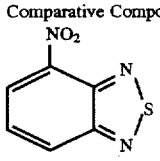

After exposing each of the film samples thus prepared by a tungsten light source of 2666K using an LB-200 filter through a step wedge having a stage difference of 0.15 for 5 seconds, the film was developed with Developer 7 or Developer 8 having the following compositions for 60 seconds at 35° C., stopped, fixed, washed with water, and dried.

| Composition of developer 7 | |
|---|---|
| N-Methyl-para-aminophenol · ½ sulfate | 7.5 g |
| Sodium Ascorbate (Sodium salt of the Reductone Compound R-1) | 30.0 g |
| Potassium Bromide | 1.0 g |
| Sodium Metaborate · tetra-hydrate | 70.0 g |
| Water to make | 1.0 liter |
| pH* | 9.8 |
| **Composition of Developer 8** | |
| 1-Phenyl-3-pyrazolidone | 7.1 g |
| Sodium Ascorbate (Sodium salt of the Reductone Compound R-1) | 30.0 g |
| Potassium Bromide | 1.0 |
| Sodium Metaborate · tetra-hydrat | 70.0 g |
| Water to make | 1.0 liter |
| pH* | 9.8 |

(*): After adding water to make 1.0 liter, pH of each developer was adjusted to 9.8 with an aqueous 5% sulfuric acid solution.

The results of the photographic characteristics obtained are shown in Table 7 below.

TABLE 7

| Film No. | Photographic Characteristics | Developer 7 | Developer 8 |
|---|---|---|---|
| 7 | Fog | 0.04 | 0.04 |
| | Relative Sens. | 34 | 31 |
| | Gamma | 4.5 | 4.3 |
| | Pepper | A | A |
| 8 | Fog | 0.04 | 0.04 |
| | Relative Sens. | 5 | 5 |
| | Gamma | 4.4 | 4.3 |
| | Pepper | A | A |
| 9 | Fog | 0.04 | 0.04 |
| | Relative Sens. | 100 | 97 |
| | Gamma | 18.5 | 17.6 |
| | Pepper | A | A |
| 10 | Fog | 0.04 | 0.04 |
| | Relative Sens. | 105 | 100 |
| | Gamma | 22.1 | 20.3 |
| | Pepper | A | A |
| 11 | Fog | 0.04 | 0.04 |

TABLE 7-continued

| Film No. | Photographic Characteristics | Developer 7 | Developer 8 |
|---|---|---|---|
| | Relative Sens. | 103 | 98 |
| | Gamma | 21.0 | 18.7 |
| | Pepper | A | A |
| 12 | Fog | 0.04 | 0.04 |
| | Relative Sens. | 106 | 101 |
| | Gamma | 21.7 | 19.5 |
| | Pepper | A | A |

Film Nos. 7 and 8 are Comparative Example.

Film Nos. 9 to 12 are Examples of this invention.

In Table 7, the relative sensitivity, the fog, the gamma, and the pepper have the same meanings as in Table 1 except that the sensitivity in the case of developing Film No. 9 with Developer 7 for 60 seconds at 35° C. is shown as 100.

As shown in Table 7, it can be seen that in the cases of Film No. 7 without being added with the 2,1,3-benzothiadiazole compound for use in this invention and Film No. 8 added with the comparative compound, a high contrast is not obtained even when developed with each developer and in particular, in the case of Film No. 8 added with the comparative compound, the relative sensitivity is greatly lowered.

On the other hand, in the case of Film Nos. 9, 10, 11, and 12 each added with the 2,1,3-benzothiadiazole compound for use in this invention, good images having a high gamma and a high sensitivity are obtained when developed with each developer. In addition, each film has no pepper.

As described above, it can be seen that by developing the silver halide photographic materials added with each of the 2,1,3-benzothiadiazole compounds for use in this invention with the alkaline developer containing the reductone compound as the developing agent, good high-contrast images having no pepper and less fog are obtained.

EXAMPLE 7

After exposing each of samples of Film Nos. 7, 9, 10, 11 and 12 prepared in Example 6 by a tungsten light source of 2666K using an LB-200 filter through a step wedge having a stage difference of 0.15 for 5 seconds, the film was developed with Developer 4 (the Invention) described in Example 3 for 60 seconds at 35° C., stopped, fixed, washed with water, and dried.

The results of the photographic characteristics obtained are shown in Table 8 below.

TABLE 8

| Test No. | Film No. (Added Compound) | Photographic Characteristics |
|---|---|---|
| 6 | 7 | Fog 0.04 |
| | (none) | Relative Sens. 100 |
| | | Gamma 26.3 |
| | | Pepper A |
| 7 | 9 | Fog 0.05 |
| | (II-6) | Relative Sens. 173 |
| | | Gamma 24.0 |
| | | Pepper A |
| 8 | 10 | Fog 0.05 |
| | (II-58) | Relative Sens. 196 |
| | | Gamma 25.5 |
| | | Pepper A |
| 9 | 11 | Fog 0.05 |

TABLE 8-continued

| Test No. | Film No. (Added Compound) | Photographic Characteristics |
|---|---|---|
| | (III-3) | Relative Sens. 170 |
| | | Gamma 24.1 |
| | | Pepper A |
| 10 | 12 | Fog 0.05 |
| | (IV-4) | Relative Sens. 208 |
| | | Gamma 26.0 |
| | | Pepper A |

Test Nos. 6 to 10 are Examples of this invention.

In Table 8, the relative sensitivity, the gamma, the fog, and the pepper have the same meanings as in Table 1 except that the sensitivity in the case of developing the film of Test No. 6 with Developer 4 for 60 seconds at 35° C. is shown as 100.

As is clear from Table 8, it can be seen that in the case of developing using Developer 4 added with the 2,1,3-benzothiazole compound (Compound II-1) for use in this invention, even Film No. 7 containing no specific contrast-increasing compound in the film shows the super high contrast having a gamma of higher than 20, and furthermore, in the cases of developing Film Nos. 9, 10, 11, and 12 each added with the 2,1,3-benzothiadiazole compound for use in this invention with Developer 4 added with the 2,1,3-benzothiadiazole compound (Compound II-1) for use in this invention, the sensitivity is increased in addition to the increase of the contrast. In addition, each film has no pepper.

As described above, it can be seen that by developing the silver halide photographic materials each added with the 2,1,3-benzothiadiazole compound for use in this invention with the developer added with the 2,1,3-benzothiadiazole compound for use in this invention, good high contrast images having a high sensitivity and having no pepper and less fog are obtained.

As described above, by developing a previously image-exposed silver halide photographic material with an alkaline developer containing a reductone compound as the main developing agent in the presence of the 1,2,5-thiadiazole compound and/or the 2,1,3-benzothiadiazole compound of the present invention, super high-contrast good images having a gamma of higher than 15 and having no pepper and less fog can be obtained. In this case, the 1,2,5-thiadiazole compound and/or the 2,1,3-benzothiadiazole compound for use in this invention may be contained in the silver halide photographic material or the alkaline developer or further, may be contained in both the silver halide photographic material and the alkaline developer.

What is claimed is:

1. An alkaline photographic developer for developing a silver halide photographic material, said developer containing at least one kind of a 1,2,5-thiadiazole compound and a 2,1,3-benzothiadiazole compound represented by formula (I), (II), (III), or (IV) and a reductone compound:

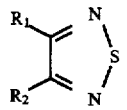

(I)

wherein $R_1$ and $R_2$, which may be the same or different, each represents a hydrogen atom, a halogen atom, a hydroxy group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_1$ and $R_2$ may form together a 5-membered ring, 6-membered ring, a 7-membered ring, or an aromatic ring; and each of these rings may contain a hetero-atom:

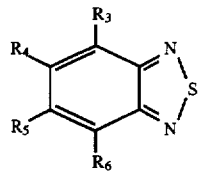

(II)

wherein $R_3$, $R_4$, $R_5$ and $R_6$, which may be the same or different, each represents a hydrogen atom, a halogen atom, a hydroxy group, a cyano group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted thiocarbamoyl group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_3$, $R_4$, $R_5$ and $R_6$ may form together a 5-membered ring, a 6-membered ring, a 7-membered ring, or an aromatic ring; and each of these rings may contain a hetero-atom:

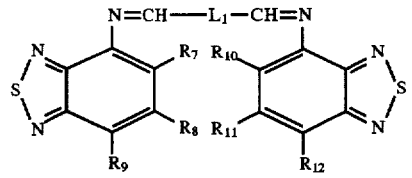

(III)

wherein $R_7$, $R_8$, $R_9$, $R_{10}$, $R_{11}$, and $R_{12}$, which may be the same or different, each represents a hydrogen atom, a halogen atom, a hydroxy group, a cyano group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted thiocarbamoyl group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_7$, $R_8$, and $R_9$ and/or $R_{10}$, $R_{11}$, and $R_{12}$ may form together a 5-membered ring, 6-membered ring, a 7-membered ring, or an aromatic ring; and each of these rings may contain a hetero-atom; and $L_1$ represents a divalent linkage group which may be further substituted by other substituent:

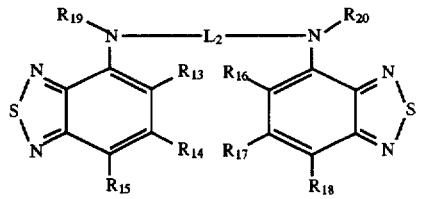

(IV)

wherein $R_{13}$, $R_{14}$, $R_{15}$, $R_{16}$, $R_{17}$, and $R_{18}$ have the same meanings as $R_7$, $R_8$, $R_9$, $R_{10}$, $R_{11}$, and $R_{12}$ in formula (III); $R_{19}$ and $R_{20}$, which may be the same or different, each represents a hydrogen atom, a substituted or unsubstituted alkyl group, a substituted or unsubstituted alkenyl group, a substituted or unsubstituted alkynyl group, a substituted or unsubstituted aryl group, a substituted or unsubstituted polyalkyleneoxy group, a substituted or unsubstituted acyl group, or a substituted or unsubstituted sulfonyl group; and $L_2$ represents a divalent linkage group which may be substituted by other substituent, provided that none of the compounds have a nitro group.

2. The alkaline photographic developer of claim 1, wherein the reductone compound is selected from the group consisting of an endiol type reductone compound, an enaminol type reductone compound, an endiamine type reductone compound, a thiol-enol type reductone compound, and an enamine-thiol type reductone compound, and the developer further contains at least one compound selected from the group consisting of a dihydroxybenzene, a 3-pyrazolidone, a 3-aminopyrazoline, a phenylenediamine, and an aminophenol as an auxiliary developing agent.

3. An alkaline photographic developer for developing a silver halide photographic material, said developer containing at least one kind of a 1,2,5-thiadiazole compound and/or a 2,1,3-benzothiadiazole compound represented by formula (I), (II), (III), or (IV) and an endiol type reductone compound represented by formula (V) or the salt thereof together with an aminophenol compound, an antifoggant, and a borate compound as auxiliary developing agents:

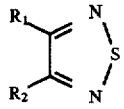

(I)

wherein $R_1$ and $R_2$, which may be the same or different, each represents a hydrogen atom, a halogen atom, a hydroxy group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_1$ and $R_2$ may form together a 5-membered ring, 6-membered ring, a 7-membered ring, or an aromatic ring; and each of these rings may contain a hetero-atom:

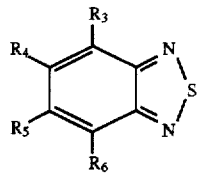

(II)

wherein $R_3$, $R_4$, $R_5$ and $R_6$, which may be the same or different, each represents a hydrogen atom, a halogen atom, a hydroxy group, a cyano group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted thiocarbamoyl group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_3$, $R_4$, $R_5$ and $R_6$ may form together a 5-membered ring, a 6-membered ring, a 7-membered ring, or an aromatic ring; and each of these rings may contain a hetero-atom:

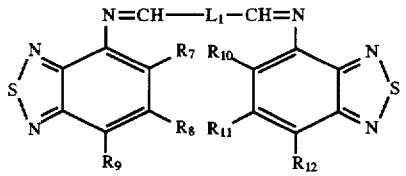

(III)

wherein $R_7$, $R_8$, $R_9$, $R_{10}$, $R_{11}$, and $R_{12}$, which may be the same or different, each represents a hydrogen atom, a halogen atom, a hydroxy group, a cyano group, a carboxylic acid group or the salt thereof, a sulfonic acid group or the salt thereof, a substituted or unsubstituted alkyl group, a substituted or unsubstituted alkenyl group, a substituted or unsubstituted alkynyl group, a substituted or unsubstituted alkoxy group, a substituted or unsubstituted alkoxycarbonyl group, a substituted or unsubstituted acyl group, a substituted or unsubstituted carbamoyl group, a substituted or unsubstituted mercapto group, a substituted or unsubstituted thiocarbamoyl group, a substituted or unsubstituted amino group, a substituted or unsubstituted sulfonyl group, a substituted or unsubstituted alicyclic group, a substituted or unsubstituted aromatic group, or a substituted or unsubstituted heterocyclic group; $R_7$, $R_8$, and $R_9$ and/or $R_{10}$, $R_{11}$, and $R_{12}$ may form together a 5-membered ring, 6-meimbered ring, a 7-membered ring, or an aromatic ring; and each of these rings may contain a hetero-atom; and $L_1$ represents a divalent linkage group which may be further substituted by other substituent:

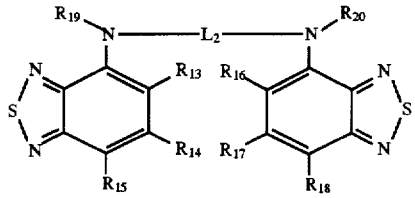

(IV)

wherein $R_{13}$, $R_{14}$, $R_{15}$, $R_{16}$, $R_{17}$, and $R_{18}$ have the same meanings as $R_7$, $R_8$, $R_9$, $R_{10}$, $R_{11}$, and $R_{12}$ in formula (III); $R_{19}$ and $R_{20}$, which may be the same or different, each represents a hydrogen atom, a substituted or unsubstituted alkyl group, a substituted or unsubstituted alkenyl group, a substituted or unsubstituted alkynyl group, a substituted or unsubstituted aryl group, a substituted or unsubstituted polyalkyleneoxy group, a substituted or unsubstituted acyl group, or a substituted or unsubstituted sulfonyl group; and $L_2$ represents a divalent linkage group which may be substituted by other substituent:

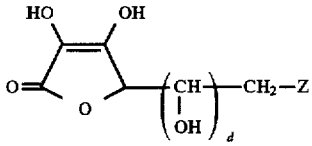

(V)

wherein Z represents a hydrogen atom or a hydroxy group and d represents 0 or an integer of from 1 to 3, provided that none of the compounds have a nitro group.

* * * * *